US009533509B2

(12) United States Patent
Okuno et al.

(10) Patent No.: US 9,533,509 B2
(45) Date of Patent: Jan. 3, 2017

(54) LIQUID EJECTING SYSTEM

(71) Applicant: SEIKO EPSON CORPORATION, Tokyo (JP)

(72) Inventors: Tokujiro Okuno, Fukuoka (JP); Munehide Kanaya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 1 day.

(21) Appl. No.: 14/517,100

(22) Filed: Oct. 17, 2014

(65) Prior Publication Data

US 2015/0109388 A1 Apr. 23, 2015

(30) Foreign Application Priority Data

Oct. 23, 2013 (JP) ..... 2013-219890

(51) Int. Cl.
*B41J 2/175* (2006.01)
*B41J 2/14* (2006.01)

(52) U.S. Cl.
CPC ..... *B41J 2/17526* (2013.01); *B41J 2/14* (2013.01); *B41J 2/175* (2013.01)

(58) Field of Classification Search
None
See application file for complete search history.

(56) References Cited

U.S. PATENT DOCUMENTS 7,014,305 B2 * 3/2006 Matsumoto ..... B41J 2/17503 347/19
8,075,108 B2 * 12/2011 Osawa ..... B41J 2/175 347/84
2004/0233245 A1 11/2004 Matsumoto et al.
2012/0038719 A1 * 2/2012 Shimizu ..... B41J 2/17523 347/86
2012/0050359 A1 3/2012 Koganehira et al.
(Continued)

FOREIGN PATENT DOCUMENTS

EP 2163390 A1 3/2010
JP 2012-020495 A 2/2012
(Continued)

OTHER PUBLICATIONS

The Extended European Search Report for the corresponding European Application No. 14189877.5 dated Aug. 5, 2016.

*Primary Examiner* — An Do
*Assistant Examiner* — Renee I Wilson
(74) *Attorney, Agent, or Firm* — Global IP Counselors, LLP

(57) ABSTRACT

A liquid ejecting system includes a liquid ejecting device, a liquid storing container, a tube, and a rotation section. The liquid ejecting device is configured and arranged to eject liquid. The liquid storing container is configured and arranged to store the liquid that is supplied to the liquid ejecting device. The tube has flexibility, is provided between the liquid storing container and the liquid ejecting device, and is configured and arranged to supply the liquid, which is in the liquid storing container, to a side of the liquid ejecting device. The rotation section rotatably supports the liquid storing container with respect to the liquid ejecting device. The tube extends toward the side of the liquid ejecting device from a side of the liquid storing container through a passage provided in the rotation section.

11 Claims, 26 Drawing Sheets

(56) References Cited

U.S. PATENT DOCUMENTS

2013/0169720 A1* 7/2013 Nakamura ..... B41J 2/175
347/86

FOREIGN PATENT DOCUMENTS

| | | | |
|---|---|---|---|
| JP | 2012-020496 | A | 2/2012 |
| JP | 2012-051307 | A | 3/2012 |
| JP | 2012-051308 | A | 3/2012 |
| JP | 2012-051309 | A | 3/2012 |
| JP | 2012-051328 | A | 3/2012 |
| JP | 2012-066563 | A | 4/2012 |

* cited by examiner

LIQUID EJECTING SYSTEM

CROSS-REFERENCE TO RELATED APPLICATIONS

This application claims priority to Japanese Patent Application No. 2013-219890 filed on Oct. 23, 2013. The entire disclosure of Japanese Patent Application No. 2013-219890 is hereby incorporated herein by reference.

BACKGROUND

Technical Field

The present invention relates to a liquid ejecting system.

Related Art

Conventionally, an ink-jet printer is well-known as an example of a liquid ejecting device. In the ink-jet printer, a printing can be performed to a print medium such as a paper by ejecting the ink, which is an example of liquid, from an ejecting head. In such ink-jet printer, conventionally, a structure that the ink stored in a tank, which is an example of a liquid storing container, is supplied to an ejecting head is well-known (see Japanese Laid-open Patent Application Publication No. 2012-51328 as an example). In this tank, an ink inlet is provided. The user can refill the ink from the ink inlet to the tank. Hereinafter, the structure that the liquid storing container such as a tank, etc. is mounted in the liquid ejecting device such as the ink-jet printer, etc. is represented as a liquid ejecting system.

In the ink-jet printer described in the aforementioned Japanese Laid-open Patent Application Publication No. 2012-51328, it is convenient if the mechanism that changes a position of a tank case, which stores a plurality of tanks, is provided. When such mechanism is provided, it is possible to reduce the inconvenience such that the posture or the position of the tank case is changed by removing the tank case from the ink-jet printer.

In the aforementioned ink-jet printer, when the position of the tank case is changed in the refill position, a connecting tube for connecting between the tank and the ejecting head is exposed. In the structure that the connecting tube is exposed, for example, when the position of the tank case is changed, there is a possibility for an occurrence that the connecting tube is pinched between the tank case and the ink-jet printer. When such problem occurs, it may be considered that the supply of the ink from the tank to the ejecting head is interfered, or the connecting tube is broken and the ink leaks.

When such problem occurs, the function of the ink-jet printer cannot be demonstrated, and the reliability of the ink-jet printer is deteriorated. For this reason, there is a problem that it is difficult to improve the reliability of the conventional liquid ejecting system.

SUMMARY

The present invention was made to solve at least a part of the aforementioned problems, and can be actualized as the following embodiments or applied examples.

A liquid ejecting system comprises a liquid ejecting device configured and arranged to eject liquid, a liquid storing container configured and arranged to store the liquid that is supplied to the liquid ejecting device, a tube having flexibility, provided between the liquid storing container and the liquid ejecting device, and configured and arranged to supply the liquid, which is in the liquid storing container, to a side of the liquid ejecting device, and a rotation section rotatably supporting the liquid storing container with respect to the liquid ejecting device. The tube extends toward the side of the liquid ejecting device from a side of the liquid storing container through a passage provided in the rotation section.

In the liquid ejecting system of this applied example, the liquid storing container is rotatably supported with respect to the liquid ejecting device by the rotation section. With this structure, when the position of the liquid storing container with respect to the liquid ejecting device is changed, the work to remove the liquid storing container from the liquid ejecting device can be omitted. Therefore, the operation when the position of the liquid storing container with respect to the liquid ejecting device is changed can be reduced. Also, in the liquid ejecting system, a tube is provided to extend from the liquid storing container side to the liquid ejecting device side through the passage provided in the rotation section so that the tube can be protected by the rotation section. Accordingly, the reliability of the tube is easily improved so that the reliability of the liquid ejecting system is easily improved.

A liquid ejecting system comprises a liquid ejecting device configured and arranged to eject liquid, a liquid storing container configured and arranged to store the liquid that is supplied to the liquid ejecting device, a tube having flexibility, provided between the liquid storing container and the liquid ejecting device, and configured and arranged to supply the liquid, which is in the liquid storing container, to a side of the liquid ejecting device side, a rotation section rotatably supporting the liquid storing container with respect to the liquid ejecting device, and a covering section provided between the liquid storing container and the liquid ejecting device, and covering at least a part of the tube. The tube extends toward the side of the liquid ejecting device from a side of the liquid storing container through the covering section.

The liquid storing container is rotatably supported with respect to the liquid ejecting device by the rotation section. Therefore, when the position of the liquid storing container with respect to the liquid ejecting device is changed, the operation to remove the liquid storing container from the liquid ejecting device can be omitted. Therefore, the operation that the position of the liquid storing container with respect to the liquid ejecting device is changed can be reduced. Also, in the liquid ejecting system, the tube is provided to extend from the liquid storing container side to the liquid ejecting device side through the covering section so that the tube can be protected by the covering section. Accordingly, the reliability of the tube is easily improved so that the reliability of the liquid ejecting system is easily improved.

In the aforementioned liquid ejecting system, a wire configured and arranged to transfer information related to the liquid storing container is provided, and the wire extends toward the side of the liquid ejecting device from the side of the liquid storing container through the passage provided in the rotation section.

In this applied example, a wire is provided to extend from the liquid storing container side to the liquid ejecting device side through the passage provided in the rotation section so that the wire can be protected by the rotation section. Therefore, the reliability of the wire is easily improved so that the reliability of the liquid ejecting system is easily improved.

In the aforementioned liquid ejecting system, a wire configured and arranged to transfer information related to the liquid storing container, and a covering section provided between the liquid storing container and the liquid ejecting device and covering at least a part of the wire are provided, and the wire extends toward the side of the liquid ejecting device from the side of the liquid storing container through the covering section.

In the applied example, the wire is provided to extend from the liquid storing container side to the liquid ejecting device side through the covering section so that the wire can be protected by the covering section. Therefore, the reliability of the wire is easily improved so that the reliability of the liquid ejecting system is easily improved.

In the aforementioned liquid ejecting system, a wire configured and arranged transfer information related to the liquid storing container is provided, and the wire extends toward the side of the liquid ejecting device from the side of the liquid storing container through the covering section.

In this applied example, the wire is provided to extend from the liquid storing container side to the liquid ejecting device side through the covering section so that the wire can be protected by the covering section. Therefore, the reliability of the wire is easily improved so that the reliability of the liquid ejecting system is easily improved.

In the aforementioned liquid ejecting system, a detection section provided in the liquid storing container and configured and arranged to detect the liquid in the liquid storing container is provided, and the information related to the liquid storing container includes ink amount detected by the detection section.

In this applied example, the information related to the ink amount is included in the information transferred by the wire so that the reliability for the information related to the ink amount is easily improved.

In the aforementioned liquid ejecting system, a memory device, which is provided in the liquid storing container and configured to record the information related to the liquid storing container, is provided, and the information related to the liquid storing container includes information read out from the memory device.

In this applied example, the information read out from the memory device is included in the information transferred by the wire so that the reliability for the information read out from the memory device is easily improved.

In the aforementioned liquid ejecting system, a frame supporting the liquid storing container is provided, and the rotation section is provided in the frame.

In this applied example, the rotation section is provided to the frame, which supports the liquid storing container, so that the liquid storing container can be rotatably supported to the liquid ejecting device by the frame.

In the aforementioned liquid ejecting system, the frame and the rotation section are formed in an integral molding.

In this applied example, the frame and the rotation section are formed in an integral molding so that the cost for the frame and the rotation section is easily reduced.

In the aforementioned liquid ejecting system, the liquid storing container has an inlet that is configured and arranged to receive the liquid, and a position of the inlet with respect to the liquid ejecting device is changeable by a rotation of the rotation section.

In this applied example, the position of the inlet with respect to the liquid ejecting device can be changed by rotating the rotation section. Therefore, for example, when the liquid is injected to the inside of the liquid storing container through the inlet, the position of the inlet can be changed in the position that is easy for the injection.

In the aforementioned liquid ejecting system, the liquid ejecting device includes a case, the liquid storing container is positioned inside of the case, and the position of the inlet is movable to an outside of the case by the rotation of the rotation section.

In this applied example, the inlet can be moved to the outside of the case by the rotation of the rotation section. Therefore, for example, when the liquid is injected to the inside of the liquid storing container through the inlet, the inlet is moved to the outside of the case, and the position of the inlet can be changed in the position that is easy for the injection.

In the aforementioned liquid ejecting system, the liquid storing container has a visible surface that allows viewing of a remaining amount of stored liquid, and a position of the visible surface with respect to the liquid ejecting device is changeable by a rotation of the rotation section.

In this applied example, the position of the visible surface with respect to the liquid ejecting device can be changed by the rotation of the rotation section. Therefore, for example, when the remaining amount of the liquid in the liquid storing container is viewed through the visible surface, it can be changed to the position where the visible surface is easily viewed.

In the aforementioned liquid ejecting system, a second liquid storing container is provided, and the liquid storing container and the second liquid storing container are moved together by a rotation of the rotation section, and a movable distance of the liquid storing container with respect to the liquid ejecting device and a movable distance of the second liquid storing container with respect to the liquid ejecting device are different from each other.

In this applied example, the liquid storing container and the second liquid storing container are moved together by the rotation of the rotation section so that it can reduce the time and effort for the rotation in comparison with the case that the liquid storing container and the second liquid storing container are separately moved.

BRIEF DESCRIPTION OF THE DRAWINGS

Referring now to the attached drawings which form a part of this original disclosure.

DETAILED DESCRIPTION OF EXEMPLARY EMBODIMENTS

As an example of the liquid ejecting system including the ink jet printer (hereinafter, it is called as a printer) which is an example of a liquid ejecting device, the embodiments will be explained with reference to figures. In each of the following figures, the scale of each member, etc., is shown so as to be different from the actual scale to make each member, etc., recognizable size.

First Embodiment

Figure 1:
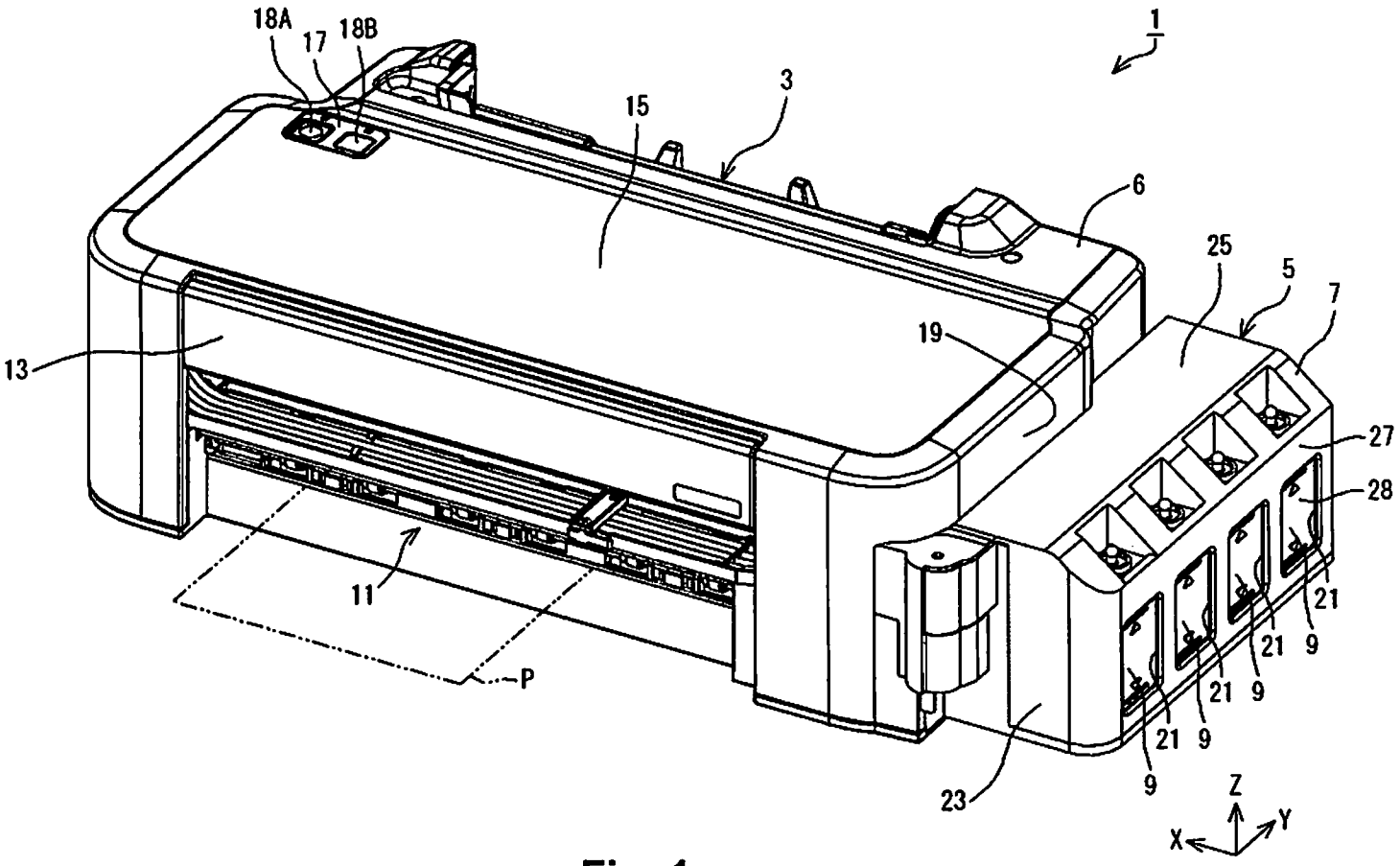
FIG. 1 is a perspective view showing a liquid ejecting system according to a first embodiment.

As shown in FIG. 1, a liquid ejecting system 1 according to the first embodiment is provided with a printer 3 and a tank unit 5. The printer 3 can perform printing to a print medium P such as a print paper, etc. by the ink which is an example of liquid. The printer 3 is provided with the first case 6. The first case 6 configures the outer shell of the printer 3. The tank unit 5 is provided with the second case 7, which is an example of a case member, and a plurality of tanks 9 (more than or equal to two). The first case 6 and the second case 7 configure the outer shell of the liquid ejecting system 1. The tank 9 is an example of the liquid storing container.

In FIG. 1, the XYZ axes, which are the axes of coordinate that are orthogonal each other, are shown. Hereinafter, the XYZ axes are shown in the drawings if necessary. In the respective XYZ axes, the direction of an arrow indicates +direction (positive direction), and the opposite direction of the arrow direction indicates −direction (negative direction). In a state that the liquid ejecting system 1 is in use, the liquid ejecting system 1 is arranged in a plane surface that is specified by the X-axis and the Y-axis. In a state that the liquid ejecting system 1 is in use, the Z-axis direction is the direction which is orthogonal to the horizontal plane surface, and the −Z-axis direction is the perpendicular down direction.

In the first case 6, the mechanism unit 10 (FIG. 4) of the printer 3 is stored. The mechanism unit 10 is a mechanism part that executes a printing operation in the printer 3. The mechanism unit 10 will be described later in detail. The plurality of tanks 9 is stored in the second case 7 as shown in FIG. 1, and the inks for printing are respectively stored. In the present embodiment, four tanks 9 are provided. In four tanks 9, a type of the ink is different in each of the tanks 9. In the present embodiment, as the types of the ink, four types of black, yellow, magenta, cyan are employed. The tank 9 storing the black ink, the tank 9 storing the yellow ink, the tank 9 storing the magenta ink, and the tank 9 storing the cyan ink are provided one each. In the liquid ejecting system 1, the plurality of tanks 9 is provided outside of the first case 6. Therefore, in the liquid ejecting system 1, the plurality of tanks 9 is not built in the first case 6 that covers the mechanism unit 10.

In the printer 3, a paper discharge section 11 is provided. In the printer 3, a print medium P is discharged from the paper discharge section 11. In the printer 3, the surface provided with the paper discharge section 11 is defined as a front surface 13. Also, the printer 3 is provided with an operation panel 17 on an upper surface 15 that intersects with the front surface 13. In the operation panel 17, a power button 18A, other control buttons 18B, etc. are provided. The tank unit 5 is provided with a side part 19 that intersects with the front surface 13 and the upper surface 15 in the first case 6. In a second case 7, window parts 21 are provided. The window parts 21 are provided with a side part 27 that intersects with a front surface 23 and an upper surface 25 in the second case 7. The window parts 21 have light permeability. In a position overlapping with the window parts 21, the aforementioned four tanks 9 are provided. Therefore, the operator who uses the liquid ejecting system 1 can view the four tanks 9 through the window parts 21. The surface overlapping with the window part 21 in each tank 9 is provided as a visible surface 28 that enables to view the ink in the tank 9. The remaining amount of the ink can be viewed in the tank 9 through the visible surface 28.

Figure 2:
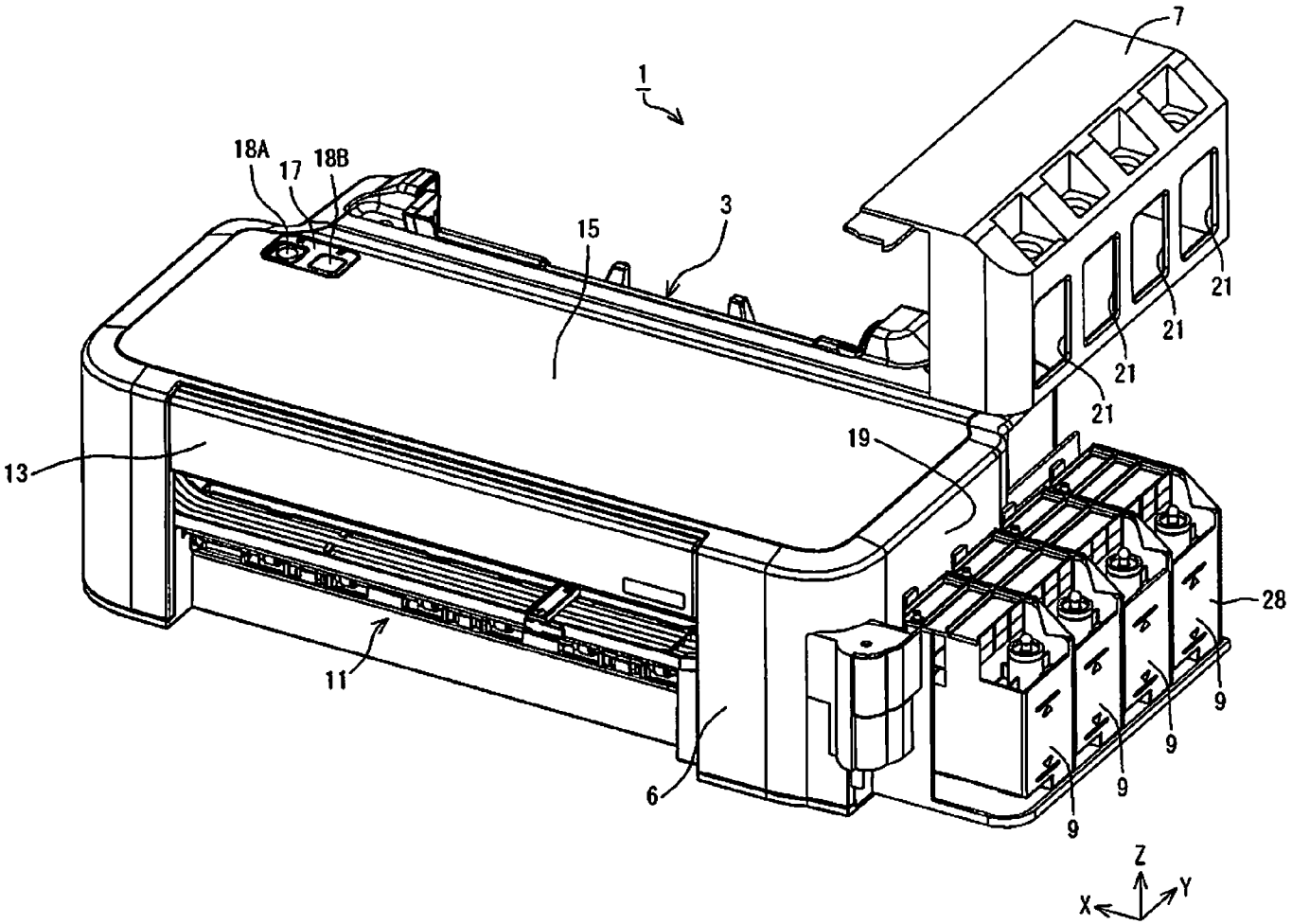
FIG. 2 is a perspective view showing the liquid ejecting system according to the first embodiment.
Figure 3:
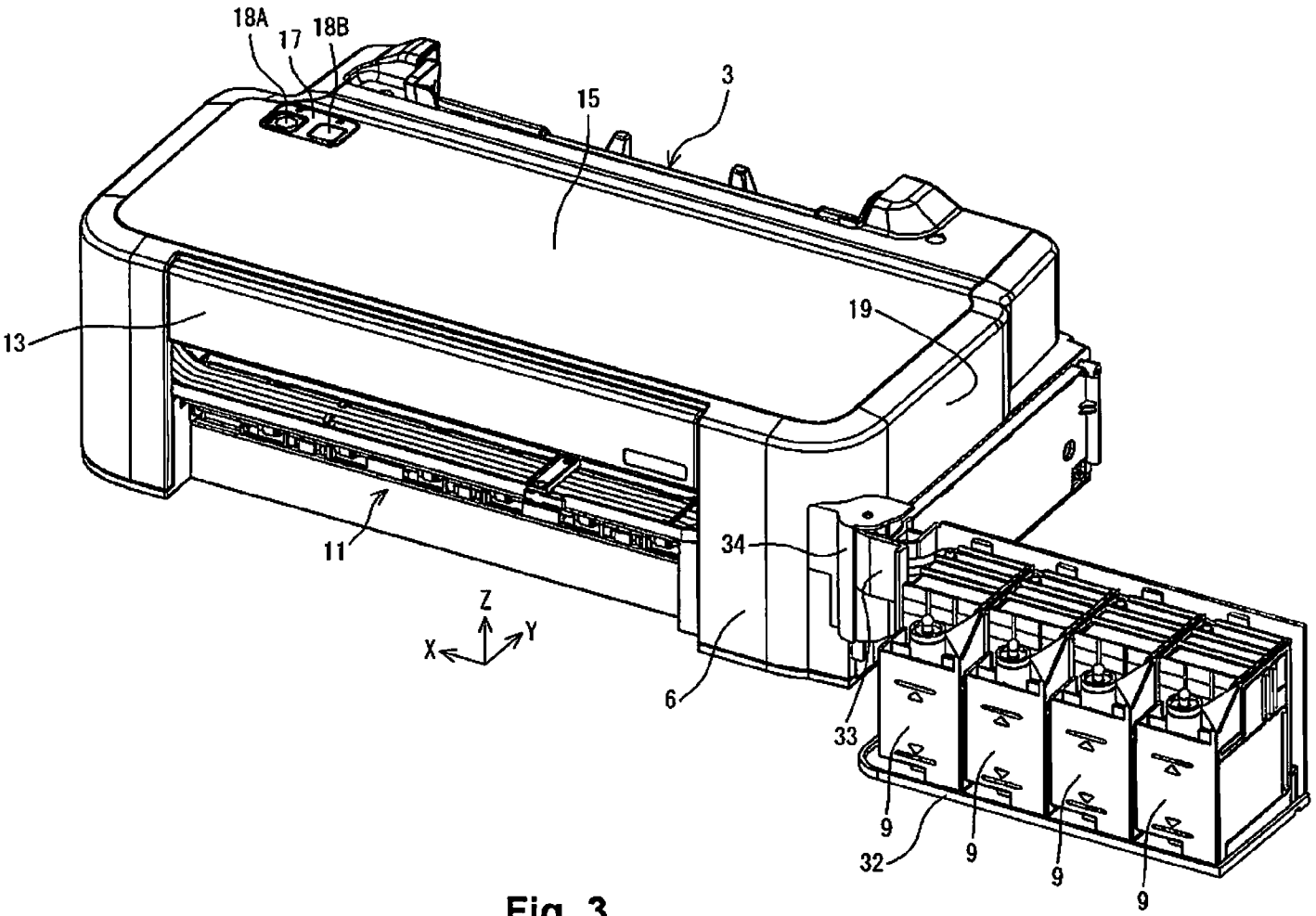
FIG. 3 is a perspective view showing a printer and tanks according to the first embodiment.

In the present embodiment, a part opposed to the window part 21 of each tank 9 has light permeability. The ink in the tank 9 can be viewed from the part having the light permeability in each tank 9. Accordingly, the operator can view the ink amount in each tank 9 by viewing four tanks 9 through the window parts 21. The first case 6 and the second case 7 are configured in a separate body. Therefore, in the present embodiment, as shown in FIG. 2, the second case 7 can be separated from the first case 6. Here, the tank unit 5 has a support frame 32. The support frame 32 is rotatably configured with respect to the first case 6 as shown in FIG. 3.

In the support frame 32, a hinge part 33 is provided. The hinge part 33 is integrally provided with the support frame 32. In the present embodiment, the support frame 32 and the hinge part 33 are formed in an integral molding. In the first case 6, a hinge receiving section 34 is provided. The hinge receiving section 34 is integrally provided with the first case 6. In the present embodiment, the first case 6 and the hinge receiving section 34 are formed in an integral molding. The hinge part 33 is engageably configured with the hinge receiving section 34. The first case 6 and the support frame 32 are connected to each other through the hinge part 33 and the hinge receiving section 34. In the state that the hinge part 33 and the hinge receiving section 34 are engaged to each other, the hinge part 33 is rotatably configured with respect to the first case 6. Here, the four tanks 9 are supported by the support frame 32. Therefore, when the support frame 32 is rotated with respect to the first case 6, the four tanks 9 are also rotated in association with the support frame 32.

Figure 4:
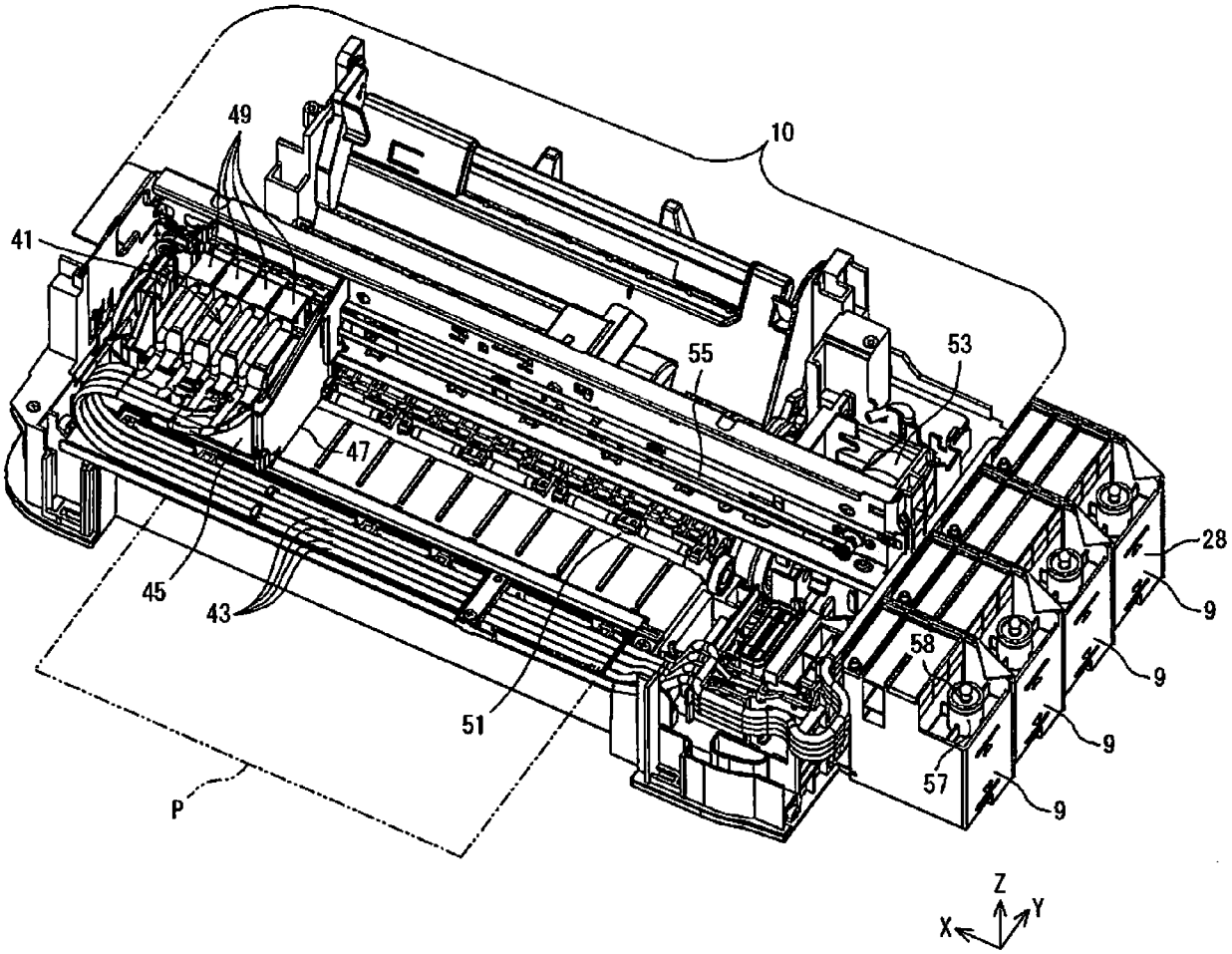
FIG. 4 is a perspective view showing a mechanism unit according to the first embodiment.

The printer 3 is provided with a print section 41 and supply tubes 43 as shown in FIG. 4 that is a perspective view showing the mechanism unit 10. The print section 41 is provided with a carriage 45, a print head 47, and four relay units 49. The print head 47 and the four relay units 49 are mounted on the carriage 45. The supply tubes 43 have flexibility and are provided between the tanks 9 and the relay units 49. The inks in the tanks are transferred to the relay units 49 through the supply tubes 43. The relay units 49 relay the inks, which are supplied through the tanks 9 and the supply tubes 43, to the print head 47. The print head 47 ejects the supplied inks as an ink droplet.

Further, the liquid ejecting system 1 is provided with a control section (not shown), a medium conveyance mechanism (not shown), and a head conveyance mechanism (not shown). The control section instructs the operation of the liquid ejecting system 1. The operation of the liquid ejecting system 1 is controlled by the control section. The medium conveyance mechanism conveys the print medium P along the Y-axis direction by driving the conveying roller 51 by the power from the motor (not shown) based on the instruction from the control section. The head conveyance mechanism conveys the carriage 45 along the X-axis direction by transferring the power from the motor 53 to the carriage 45 via the timing belt 55 based on the instruction from the control section. The print head 47 is mounted on the carriage 45. Therefore, the print head 47 is conveyed via the carriage 45 in the X-axis direction by the head conveyance mechanism. The print head 47 is supported by the carriage 45 in the state of facing to the print medium P. While the relative position of the print head 47 with respect to the print medium P is changed by the medium conveyance mechanism and the head conveyance mechanism, a printing is performed on the print medium P by ejecting the ink from the print head 47.

In the liquid ejecting system 1, an ink inlet section 57 is provided in each tank 9. The user or the operator can inject the ink to the tanks 9 from the ink inlet sections 57. For example, when the inks in the tanks 9 are consumed along with the printing and the ink amount in the tanks 9 is reduced, the user or the operator can refill the inks in the tanks 9 from the ink inlet sections 57. In the ink inlet sections 57, caps 58 are provided. The ink inlet sections 57 are covered by the caps 58. The user or the operator injects the inks to the tanks 9 from the ink inlet sections 57 after the caps 58 were removed when the inks are injected to the tanks 9.

Figure 5:
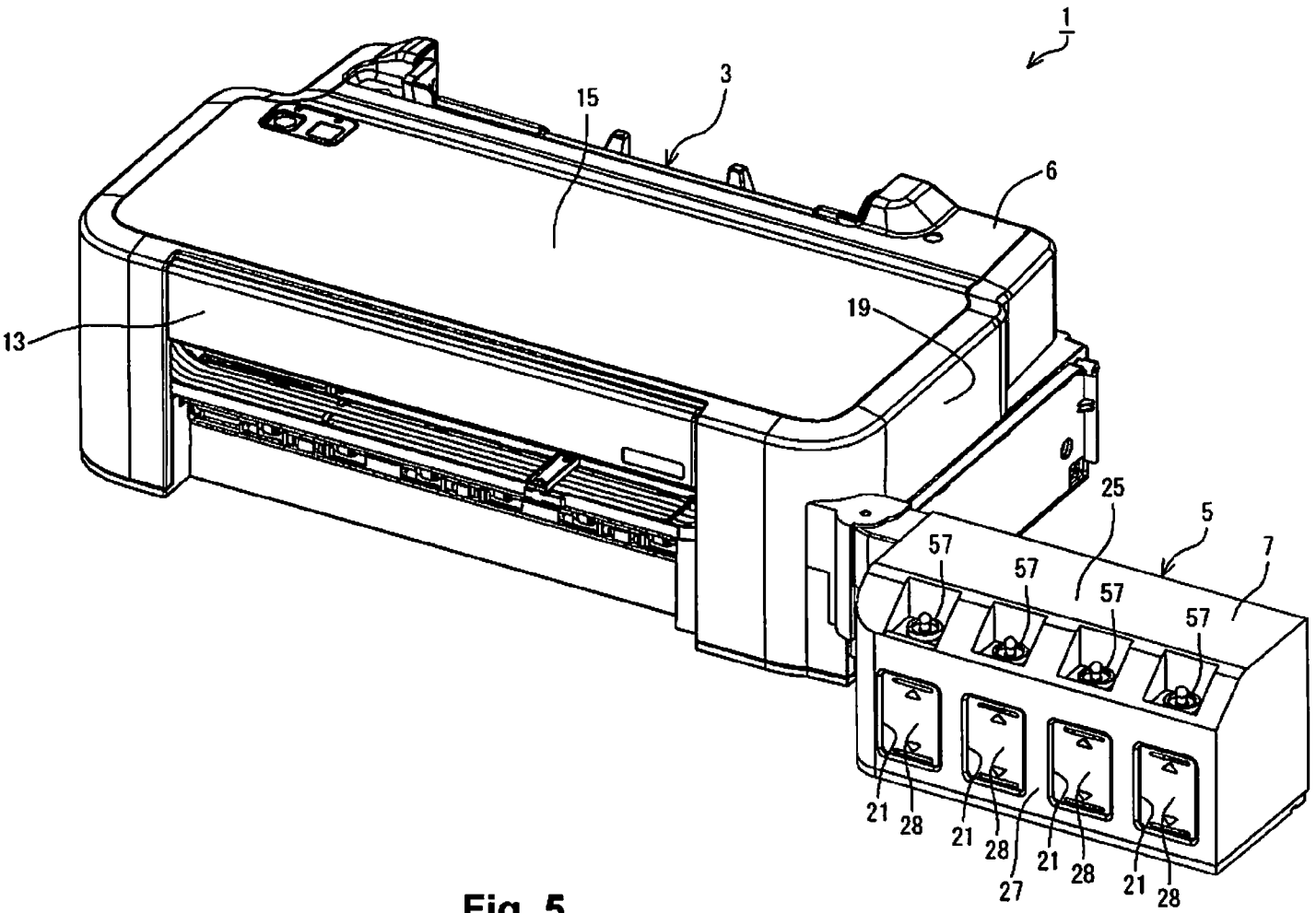
FIG. 5 is a perspective view showing a liquid ejecting system according to the first embodiment.

In the liquid ejecting system 1, as described above, the tank unit 5 is rotatably configured with respect to the first case 6. Therefore, in the liquid ejecting system 1, as shown in FIG. 5, the direction of the side part 27 of the tank unit 5 can be matched with the direction of the front surface 13 of the liquid ejecting system 1. Therefore, the direction of the window parts 21 of the second case 7 is matched with the direction of the front surface 13. Thus, the user or the operator can face to the plurality of window parts 21, respectively in the state of facing to the front surface 13 of the printer 3. That is, the user or the operator can faces to the plurality of tanks 9, respectively in the state of facing to the front surface 13 of the printer 3. As a result, it is easy to view the plurality of tanks 9, respectively so that the ink amount in each tank 9 is easily viewed and it can make easy to inject the ink to the tanks 9. Hereinafter, the state that the direction of the side part 27 is matched with the direction of the front surface 13 represents in the state that the hinge part 33 is opened. On the other hand, as shown in FIG. 1, the state that the direction of the front surface 23 is matched with the direction of the front surface 13 represents in the state that the hinge part 33 is closed. When the hinge part 33 is closed, the plurality of tanks 9 is aligned along the Y-axis direction. In this condition, when viewing from the operator who faces the front surface 13 of the printer 3, the plurality of tanks 9 is positioned to be overlapped in a direction from the front side to the back side. On the other hand, as shown in FIG. 5, when the hinge part 33 is opened, the plurality of tanks 9 is aligned along the X-axis direction. In this condition, when viewing from the operator who faces the front surface 13 of the printer 3, the plurality of tanks 9 is positioned to be aligned in the lateral direction. Therefore, in the present embodiment, the plurality of tanks 9 is moved together by rotating the hinge part 33. In the plurality of tanks 9, the moving distance by the rotation of the hinge part 33 is different between the tanks 9.

The position of the ink inlet sections 57 is different at the time of the condition that the hinge part 33 is closed and at the time of the condition that the hinge part 33 is opened. That is, a position of the ink inlet section 57 with respect to the printer 3 is changed by the rotation of the hinge part 33. As shown in FIG. 4, at the time of the condition that the hinge part 33 is closed, the plurality of ink inlet sections 57 are aligned along the Y-axis direction. In this condition, when viewing from the operator who faces the front surface 13 of the printer 3, the plurality of tanks 9 is positioned to be overlapped in the direction from the front side to the back side. In the operation that the ink is injected to the tank 9, which is positioned in the back side with respect to the plurality of tanks 9 in such arrangement, it is hard to inject because the operator's hand intersects with the tank positioned in the front side. On the other hand, as shown in FIG. 5, at the time of the condition that the hinge part 33 is opened, the plurality of ink inlet sections 57 is aligned along the X-axis direction. In this condition, when viewing from the operator who faces the front surface 13 of the printer 3, the plurality of tanks 9 is positioned to be arranged in the lateral direction. With such arrangement, when the ink is injected to the tanks 9, it is easy to avoid the situation that the operator's hand intersects with other tanks 9.

Further, a position of the aforementioned visible surface 28 is different at the time of the condition that the hinge part 33 is closed and at the time of the condition that the hinge part 33 is opened. That is, the position of the visible surface 28 with respect to the printer 3 is changed by the rotation of the hinge part 33. As shown in FIG. 4, at the time of the condition that the hinge part 33 is closed, the plurality of visible surfaces 28 is aligned along the Y-axis direction. In this condition, when viewing from the operator who faces the front surface 13 of the printer 3, the plurality of tanks 9 is positioned to be overlapped in the direction from the front side to the back side. It is hard to confirm the ink remaining amount in such arrangement of the plurality of tanks 9. On the other hand, as shown in FIG. 5, at the time of the condition that the hinge part 33 is opened, the plurality of visible surfaces 28 is aligned along the X-axis direction. In this condition, when viewing from the operator who faces the front surface 13 of the printer 3, the plurality of visible surfaces 28 is positioned to align in the lateral direction. With such arrangement, the ink remaining amount of each tank 9 is easily confirmed.

Figure 6:
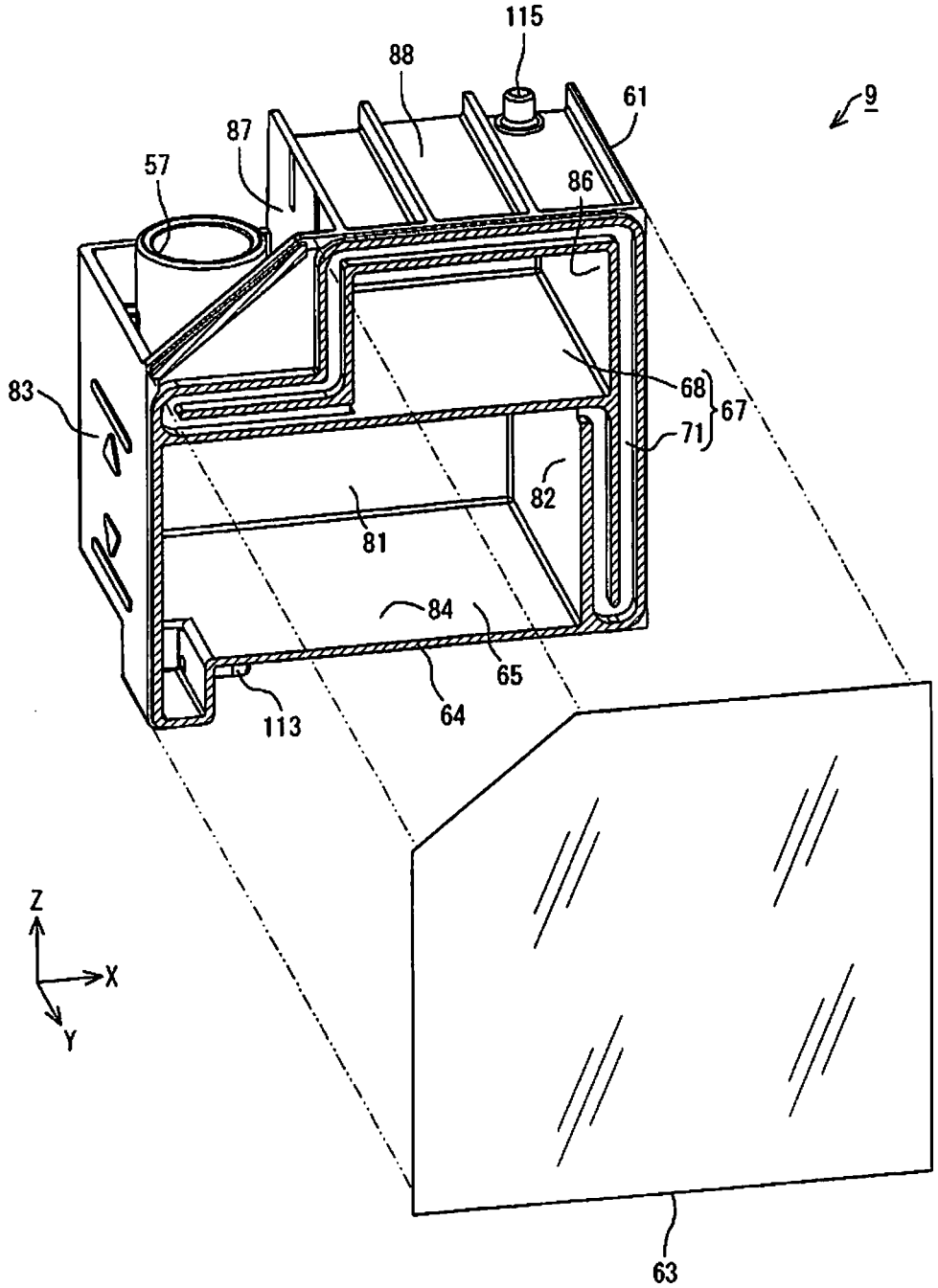
FIG. 6 is an exploded perspective view showing the tank according to the first embodiment.

The tank 9 is provided with a case 61, which is an example of a tank main body, and a sheet member 63. For example, the case 61 is configured by synthetic resin of nylon or polypropylene, etc. Further, the sheet member 63 is formed in a film shape by the synthetic resin (e.g., nylon, polypropylene, etc.), and has flexibility. In the present embodiment, the sheet member 63 has light permeability. The tank 9 has a configuration that the case 61 and the sheet member 63 are bonded. In the case 61, the joint section 64 is provided. In FIG. 6, the hatching is applied to the joint section 64 so as to easily understand the configuration. The sheet member 63 is bonded to the joint section 64 of the case 61. In the present embodiment, the case 61 and the sheet member 63 are bonded by welding.

Figure 7:
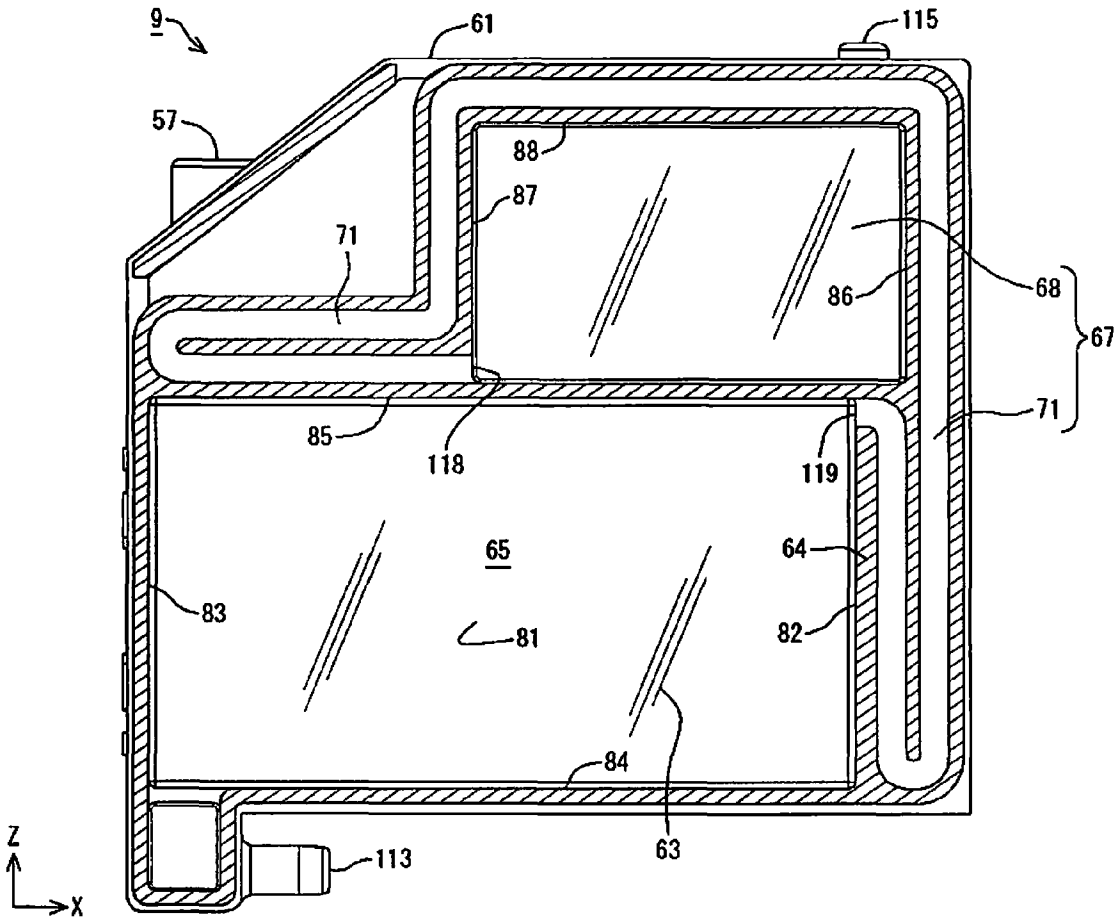
FIG. 7 is a side view showing the tank according to the first embodiment when viewing from a sheet member side.

As shown in FIG. 7, the tank 9 is provided with a storage section 65, and a communication section 67. The communication section 67 is provided with an atmospheric chamber 68, and a communication passage 71. In the tank 9, the ink is stored in the storage section 65. FIG. 7 shows the tank 9 when viewing from the sheet member 63 side and the case 61 is drawn across the sheet member 63. The storage section 65, the atmospheric chamber 68, and the communication passage 71 are mutually separated by the joint section 64.

The case 61 is provided with the first wall 81, the second wall 82, the third wall 83, the fourth wall 84, the fifth wall 85, the sixth wall 86, the seventh wall 87, and the eighth wall 88. In the opposite side from the storage section 65 side of the fifth wall 85, the atmospheric chamber 68 is arranged. When the first wall 81 is viewed in a plan view from the sheet member 63 side, the storage section 65 is surrounded by the second wall 82, the third wall 83, the fourth wall 84, and the fifth wall 85.

Further, when the first wall 81 is viewed in a plan view from the sheet member 63 side, the atmospheric chamber 68 is surrounded by the fifth wall 85, the sixth wall 86, the seventh wall 87, and the eighth wall 88. The first wall 81 of the storage section 65 and the first wall 81 of the atmospheric chamber 68 are the same wall to each other. That is, in the present embodiment, the storage section 65 and the atmospheric chamber 68 commonly share the first wall 81.

Figure 8:
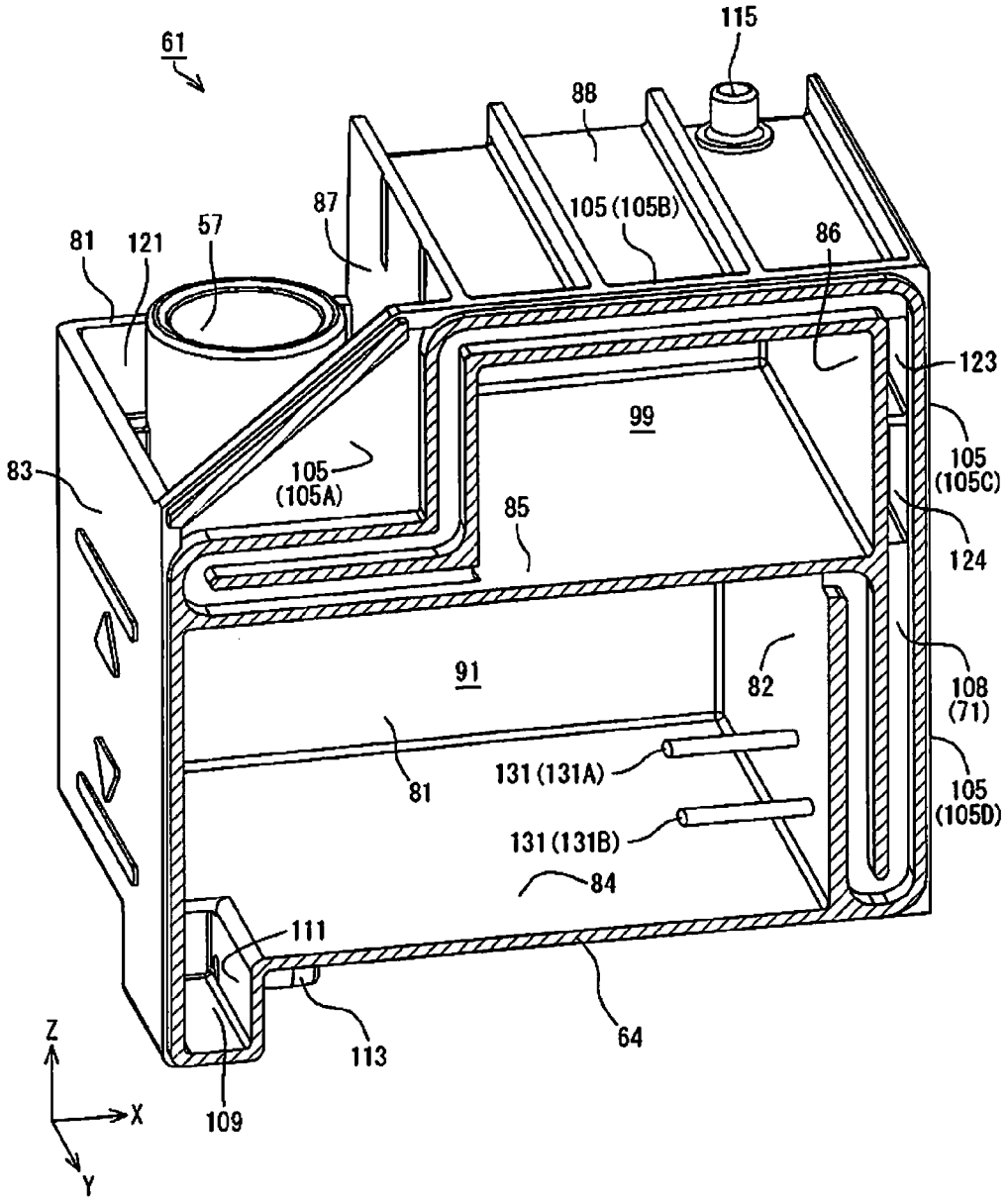
FIG. 8 is a perspective view showing a case according to the first embodiment.

As shown in FIG. 8, the second wall 82, the third wall 83, the fourth wall 84, and the fifth wall 85 are respectively intersected with the first wall 81. The second wall 82 and the third wall 83 are provided in the position facing each other through the first wall 81 in the X-axis direction. The fourth wall 84 and the fifth wall 85 are provided in the position facing each other through the first wall 81 in the Z-axis direction. The second wall 82 is respectively intersected with the fourth wall 84 and the fifth wall 85. The third wall 83 is respectively intersected with the fourth wall 84 and the fifth wall 85.

The second wall 82, the third wall 83, the fourth wall 84, the fifth wall 85 are protruded in the +Y-axis direction from the first wall 81. Therefore, a recessed section 91 is configured by the first wall 81 as the main wall, the second wall 82 extending in the +Y-axis direction from the main wall, the third wall 83, the fourth wall 84, and the fifth wall 85. The recessed section 91 is provided in the direction that a concave is formed toward the −Y-axis direction. The recessed section 91 is formed toward in the +Y-axis direction, that is, the opening toward the sheet member 63 side (FIG. 6). In other words, the recessed section 91 is formed toward the −Y-axis direction, that is, it is provided in the direction that a concave is formed toward the opposite side from the sheet member 63 side (FIG. 6). When the case 61 is bonded to the sheet member 63, the recessed section 91 is peeled off by the sheet member 63 so as to configure the storage section 65. The first wall 81 to the eighth wall 88 are not limited to a flat wall respectively, and it may include unevenness.

As shown in FIG. 7, the sixth wall 86 is protruded from the fifth wall 85 to the opposite side of the fourth wall 84 side of the fifth wall 85, that is, the +Z-axis direction side of the fifth wall 85. The seventh wall 87 is protruded from the fifth wall 85 to the opposite side of the fourth wall 84 side of the fifth wall 85, that is, the +Z-axis direction side of the fifth wall 85. The sixth wall 86 and the seventh wall 87 are provided in the position facing each other via the atmospheric chamber 68 in the X-axis direction. The eighth wall 88 is provided in the position facing to the fifth wall 85 via the atmospheric chamber 68 in the Z-axis direction. The sixth wall 86 intersects with the fifth wall 85 and the eighth wall 88 respectively. The seventh wall 87 intersects with the fifth wall 85 and the eighth wall 88 respectively.

As shown in FIG. 8, the sixth wall 86, the seventh wall 87, and the eighth wall 88 are respectively protruded from the first wall 81 in the +Y-axis direction. The recessed section 99 is configured by the fifth wall 85 that extends from the first wall 81 in the +Y-axis direction, the sixth wall 86, the seventh wall 87, and the eighth wall 88. The recessed section 99 opens toward the +Y-axis direction, that is, the sheet member 63 side (FIG. 6). In other words, the recessed section 99 is provided in a direction that a concave is formed toward the −Y-axis direction, that is, the opposite side of the sheet member 63 side (FIG. 6). When the sheet member 63 is bonded to the case 61, the recessed section 99 is peeled off by the sheet member 63 so as to configure the atmospheric chamber 68. The projection amounts of the second wall 82 to the eighth wall 88 from the first wall 81 are set in the same projection amount each other.

The second wall 82 and the sixth wall 86 have a step in the X-axis direction. The second wall 82 is positioned in the third wall 83 side than the sixth wall 86 side, that is, the −X-axis direction than the sixth wall 86. Further, the third wall 83 and the seventh wall 87 have a step in the X-axis direction. The seventh wall 87 is positioned in the second wall 82 side than the third wall 83, that is, the +X-axis direction than the third wall 83. In the condition that the first wall 81 is viewed in a plan view from the sheet member 63 side, the ink inlet section 57 is provided between the third wall 83 and the seventh wall 87. The ink inlet section 57 is provided in the fifth wall 85.

As shown in FIG. 8, a projection section 105 is provided in the case 61. The communication passage 71 is provided in the projection section 105. The projection section 105 has a protruded part 105A toward the +Z-axis direction side from the fifth wall 85 along the edge of the opening of the recessed section 91 in the region of the −X-axis direction than the seventh wall 87 within the fifth wall 85. The part 105A is protruded toward the −X-axis direction side from the seventh wall 87 along the edge of the opening of the recessed section 99 in the seventh wall 87. Also, the projection section 105 has a protruded part 1058 toward the +Z-axis direction from the eighth wall 88. Further, in the sixth wall 86, the projection section 105 has a protruded part 105C toward the +X-axis direction side from the sixth wall 86 along the edge of the opening of the recessed section 99. Further, in the second wall 82, the projection section 105 has a protruded part 105D toward the +X-axis direction from the second wall 82 along the edge of the opening of the recessed section 91. In the projection section 105, the communication passage 71 is configured as a groove 108 provided in the direction that the concave is formed toward the opposite side of the sheet member 63 side.

Here, in the recessed section 91, a recessed section 109 is provided. The recessed section 109 is provided in the direction that a concave is formed toward the opposite side of the fifth wall 85 side than the fourth wall 84, that is, the −Z-axis direction side than the fourth wall 84. In the recessed section 109, a supply port 113 is provided in the wall 111 facing to the third wall 83 and the second wall 82. Therefore, in the condition that the first wall 81 is viewed in a plan view, the supply port 113 is provided between the third wall 83 and the second wall 82. The ink inlet section 57 and the supply port 113 communicate between the outside of the case 61 and the inside of the recessed section 91, respectively. The supply port 113 is protruded toward the second wall 82 side along the X-axis direction from the wall 111.

An air communicating port 115 is provided in the eighth wall 88. The air communicating port 115 is protruded from the eighth wall 88 toward the opposite side of the fifth wall 85 side of the eighth wall 88, that is, the +Z-axis direction side of the eighth wall 88. When the eighth wall 88 is viewed in a plan view, that is, when the eighth wall 88 is viewed in a plan view in the XY plane surface, the air communicating port 115 is provided in the position overlapping with the recessed section 99. The air communicating port 115 communicates between the outside of the case 61 and the inside of the recessed section 99. The air communicating port 115 is a passage for the air transfarable from the outside of the case 61 to the inside of the recessed section 99. In the case 61, the joint section 64 is provided along the respective outlines of the recessed section 91, the recessed section 99, the recessed section 109, and the communication passage 71.

As shown in FIG. 6, the sheet member 63 faces the first wall 81 through the second wall 82 to the eighth wall 88 in the Y-axis direction. The sheet member 63 has a size that covers the recessed section 91, the recessed section 99, the recessed section 109, and the projection section 105 in a plane view. In the state that it has a space with the first wall 81, the joint section 64 is welded. Therefore, the recessed section 91, the recessed section 99, the recessed section 109, and the communication passage 71 are sealed by the sheet member 63. Thus, the sheet member 63 functions as a lid for the case 61.

As shown in FIG. 7, the communication passage 71 is provided with a communicating port 118, and a communicating port 119. The communicating port 118 is an opening section that opens toward the inside of the atmospheric chamber 68. The communicating port 119 is an opening section that opens toward the inside of the storage section 65. The atmospheric chamber 68 communicates to the storage section 65 through the communicating port 119 via the communication passage 71 from the communicating port 118. Accordingly, the storage section 65 communicates to the outside of the tank 9 through the atmospheric chamber 68 and the air communicating port 115. That is, the communication section 67 communicates between the air communicating port 115 and the storage section 65. The air that flows from the air communicating port 115 to the inside of the atmospheric chamber 68 flows to the inside of the storage section 65 through the communication passage 71.

The ink inlet section 57 is provided in the fifth wall 85. As shown in FIG. 8, the ink inlet section 57 is provided in the recessed section 121 that is surrounded by the seventh wall 87, the projection section 105, the third wall 83 and the first wall 81. As described above, the projection section 105 is protruded to the eighth wall 88 side than the fifth wall 85. Further, the seventh wall 87 is protruded to the eighth wall 88 side than the fifth wall 85. In the same manner, in the present embodiment, the first wall 81 and the third wall 83 are respectively protruded to the eighth wall 88 side than the fifth wall 85. The projection section 105 intersects with both of the seventh wall 87 and the third wall 83. Further, the first wall 81 intersects with both of the third wall 83 and the seventh wall 87. Therefore, the region that is the third wall 83 side than the seventh wall 87 in the fifth wall 85 configures the recessed section 121 surrounded by the seventh wall 87, the projection section 105, the third wall 83, and the first wall 81. The recessed section 121 is provided in the position that a concave is formed toward the direction from the fifth wall 85 side to the fourth wall 84 side.

With the aforementioned configuration, the ink inlet section 57 is surrounded by the seventh wall 87, the projection section 105, the third wall 83, and the first wall 81. In other words, the ink inlet section 57 is provided within the region surrounded by the seventh wall 87, the projection section 105, the third wall 83, and the first wall 81 in the fifth wall 85. The recessed section 121 has the function of the ink receiving member. For example, the ink receiving member enables to receive the ink overflowed from the ink inlet section 57 or the ink fallen down at the time of injection. Therefore, the recessed section 121 has the function as the ink receiving member that receives the ink.

As shown in FIG. 8, in the case 61 of the tank 9, two electrodes 131, which are an example of the detection section capable of detecting liquid, are provided. The two electrodes 131 are protruded in the recessed section 91 by penetrating through the second wall 82 from the outside of the case 61. The two electrodes 131 have a bar shape and respectively extend along the X-axis direction. The two electrodes 131 are aligned with an interval from each other in the Y-axis direction. The two electrodes 131 are positioned between the fourth wall 84 and the fifth wall 85. The two electrodes 131 are positioned in the fifth wall 85 side than the supply port 113. The two electrodes 131 are arranged apart from the fourth wall 84 and the fifth wall 85 respectively. Therefore, a space is provided between the two electrodes 131 and the fourth wall 84. In the same manner, a space is provided between the two electrodes 131 and the fifth wall 85.

The two electrodes 131 are used for detecting the remaining amount of the ink stored in the recessed section 91. It can detect that the remaining amount of the ink is lower than a predetermined amount based on the change of the electric resistance between the two electrodes 131. That is, the information related to the ink amount of the tank 9 is detected by the two electrodes 131. The information related to the ink amount is one of the information related to the tank 9. Hereinafter, when the two electrodes 131 are respectively identified, the two electrodes 131 are represented as the first electrode 131A and the second electrode 131B, respectively. The first electrode 131A is provided in the first wall 81 side than the second electrode 131B in the Y-axis direction. In the present embodiment, one of the two electrodes 131 is provided in the higher position than the other one in the Z-axis direction. In the example shown in FIG. 8, the first electrode 131A of the two electrodes 131 is provided in the higher position than the second electrode 131B in the Z-axis direction. However, the relative heights of the two electrodes 131 are not limited to this. As the relative heights of the two electrodes 131, the configuration that the heights of the first electrode 131A and the second electrode 131B are relatively the same may be employed. Further, as the relative heights of the two electrodes 131, the configuration that the second electrode 131B is higher than the first electrode 131A may be employed.

Figure 9:
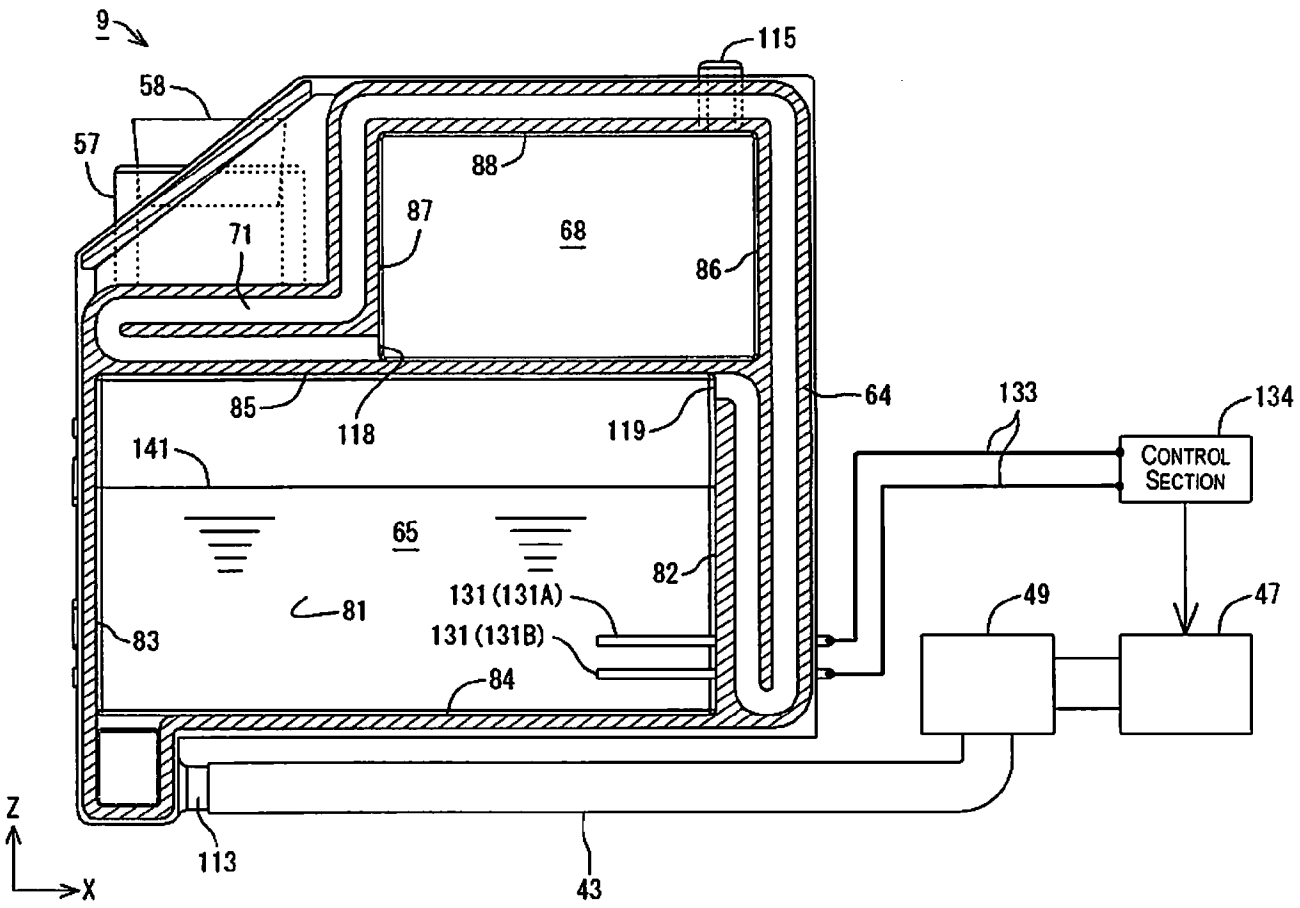
FIG. 9 is a side view showing the tank according to the first embodiment when viewing from the sheet member side.

As shown in FIG. 9, the two electrodes 131 are electrically connected to the control section 134 via the wires 133, respectively. The information related to the ink amount detected by the two electrodes 131 is transferred to the control section 134 via the wires 133. Accordingly, the wire 133 is one of the wires transferring the information related to the tank 9. As described above, the control section 134 of the liquid ejecting system 1 controls the operation of the liquid ejecting system 1. When the ink supplied to the print head 47 via the supply tube 43 from the tank 9 is consumed, the liquid level of the ink 135 in the tank 9 is lowered in the vertical lower side (−Z-axis direction). At this point, when the liquid level of the ink 135 is lowered in the vertical lower side than the first electrode 131A, the electric resistance value is increased between the first electrode 131A and the second electrode 131B. In the liquid ejecting system 1, based on the change of the electric resistance between the first electrode 131A and the second electrode 131B, it determines that the remaining amount of the ink 135 in the tank 9 reaches the lower limit.

In the liquid ejecting system 1, when it determines that the remaining amount of the ink 135 reaches the lower limit, the new ink is refilled by the user or the operator. In response to this, the user or the operator can refill the new ink to the tank 9 from the ink inlet section 57. The processing for detecting the change of the electric resistance between the first electrode 131A and the second electrode 131B, the processing for determining that the remaining amount of the ink 135 reaches the lower limit, and the processing for refilling the new ink are executed by the control section 134.

Figure 10:
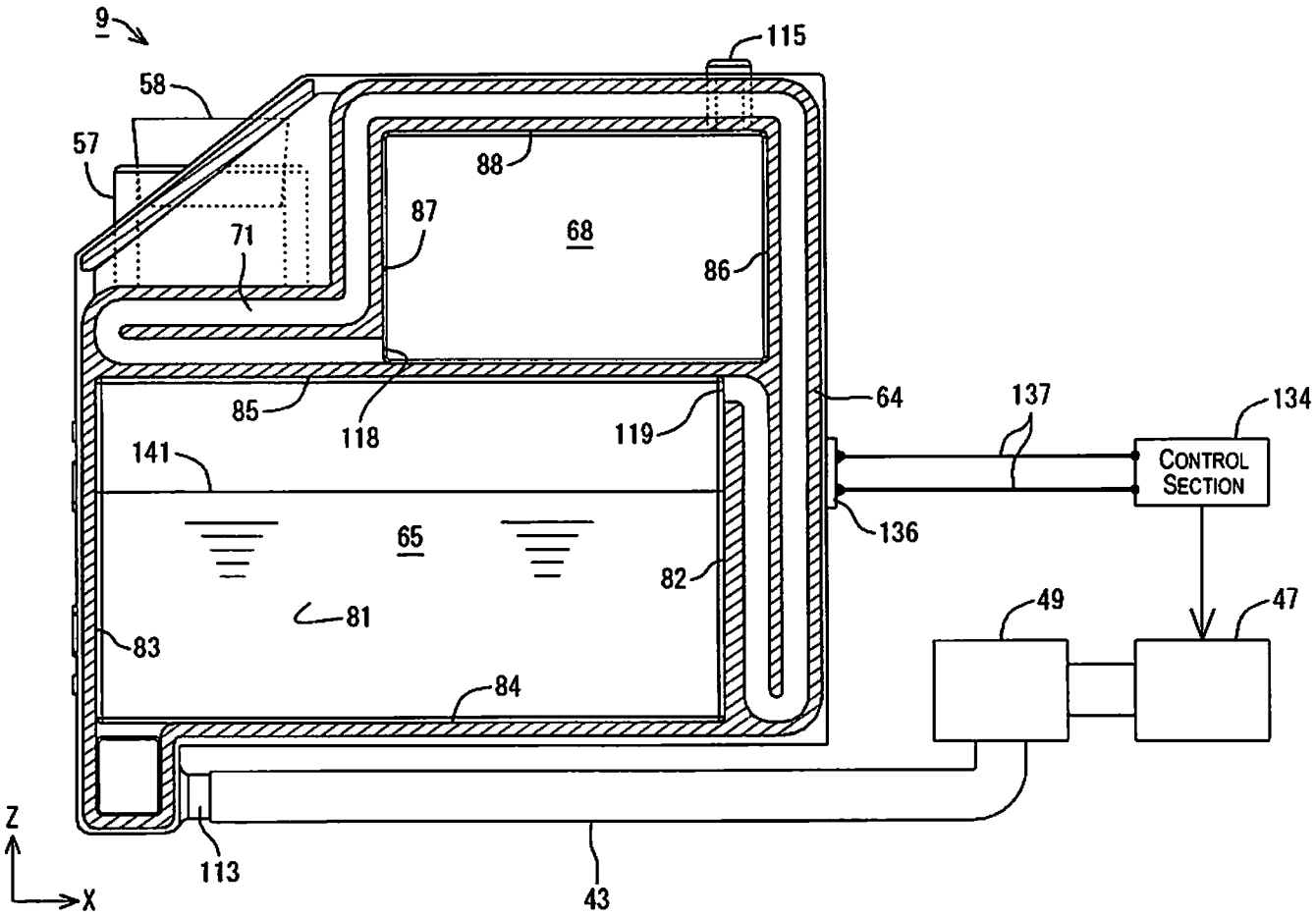
FIG. 10 is a side view showing the tank according to the first embodiment when viewing from the sheet member side.

Also, as shown in FIG. 10, in the tank 9, a memory 136, which is an example of the memory device recording the information related to the tank 9, is provided. In the information recorded in the memory 136, for example, the information indicating a number referring to the tank 9, an ink type in the tank 9, etc. is included. The memory 136 is electrically connected to the control section 134 via the wire 137. The information recorded in the memory 136 is transferred to the control section 134 via the wire 137. Accordingly, the wire 137 is one of the wires that transfer the information related to the tank 9.

Figure 11:
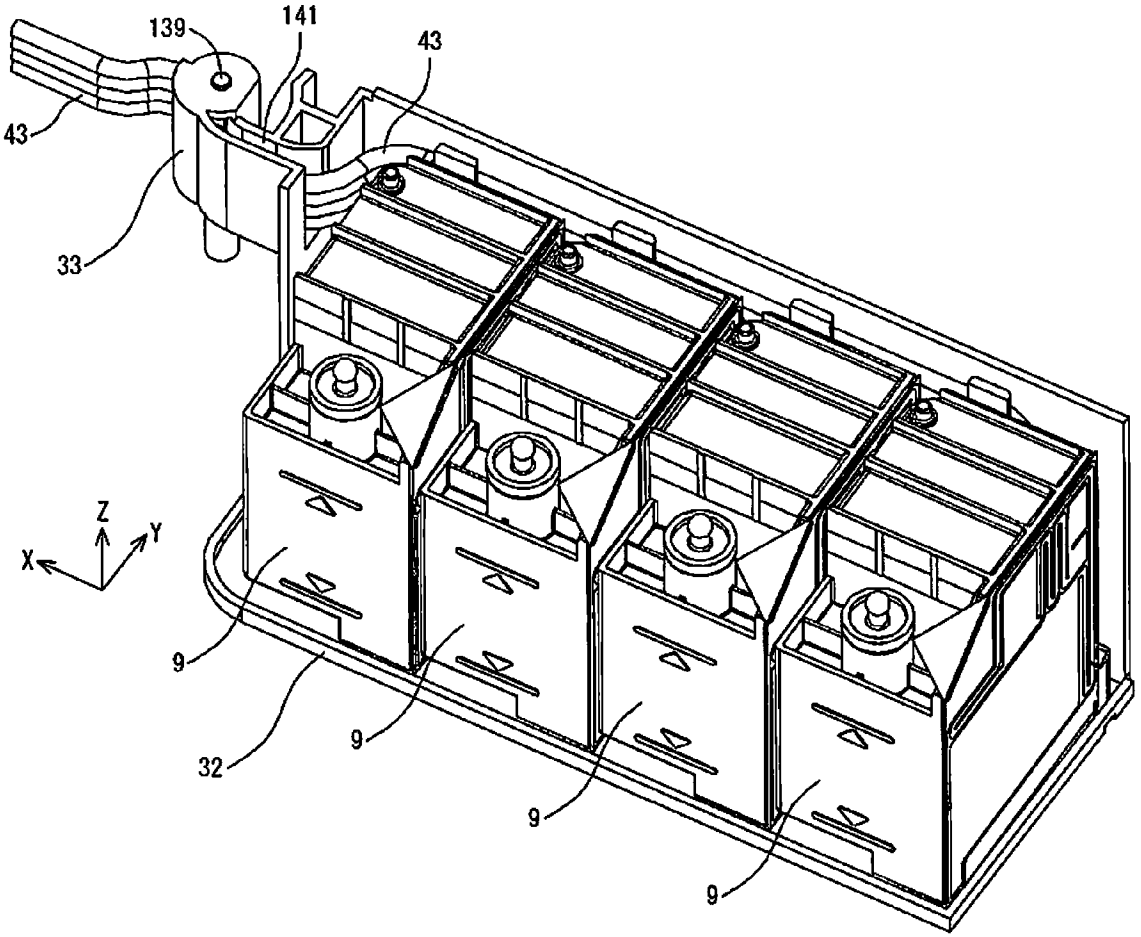
FIG. 11 is a perspective view showing a support frame and the tanks according to the first embodiment.
Figure 12:
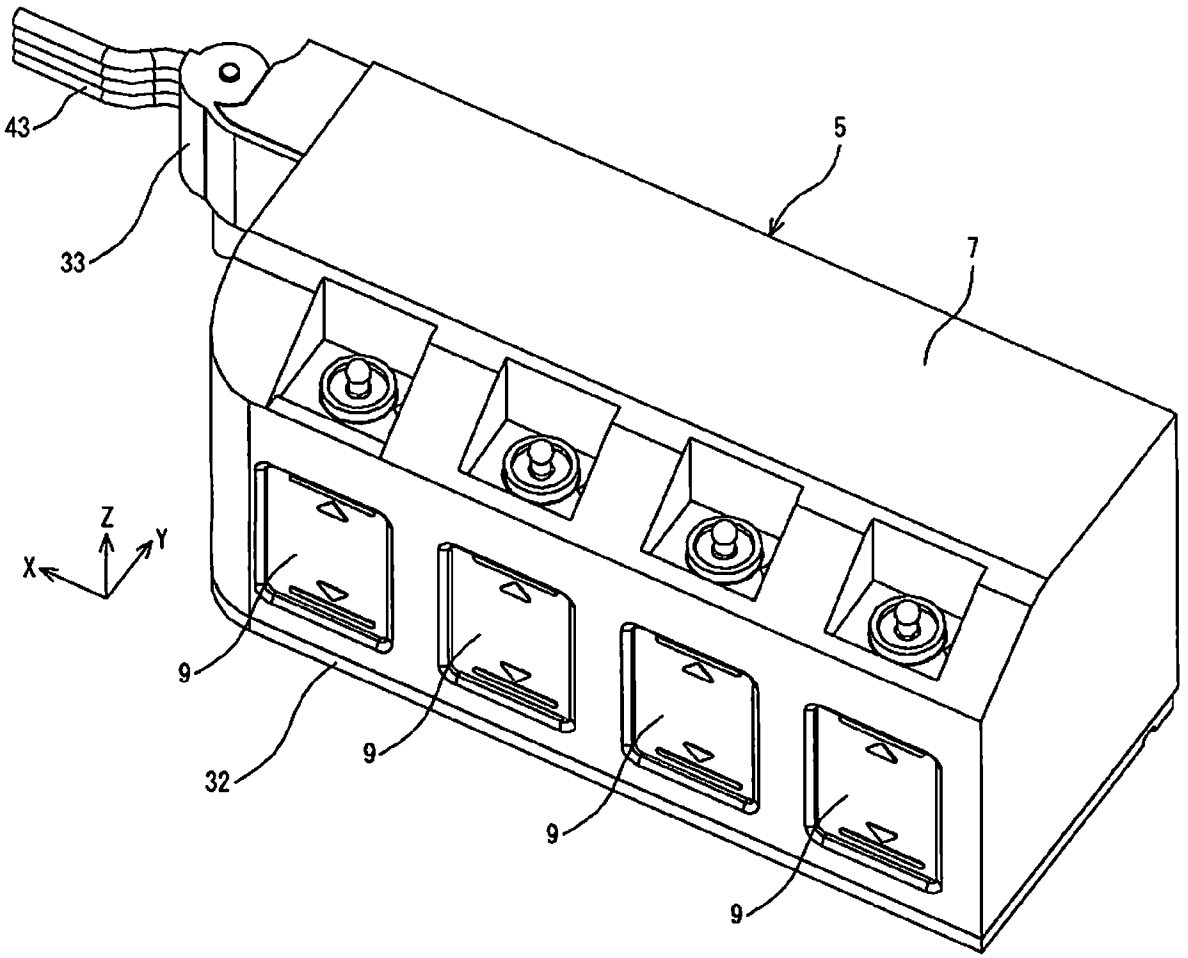
FIG. 12 is a perspective view showing a tank unit according to the first embodiment.

In the hinge part 33, as shown in FIG. 11, a shaft section 139 that rotatably supports is provided. The shaft section 139 is protruded from the hinge part 33 in the Z-axis direction. Also, in the hinge part 33, a passage 141 that the supply tubes 43 can be penetrated is provided. The supply tubes 43 connected to the tanks 9 extend to the outside of the hinge part 33 through the passage 141. With such structure, the supply tubes 43 are penetrated from the space, which is surrounded by the second case 7 and the support frame 32, to the hinge part 33, and is guided out to the outside of the space surrounded by the second case 7 and the support frame 32. In the present embodiment, the aforementioned wires 133 (FIG. 9) and the wires 137 (FIG. 10) extend to the outside of the hinge part 33 through the passage 141 (FIG. 11).

Figure 13:
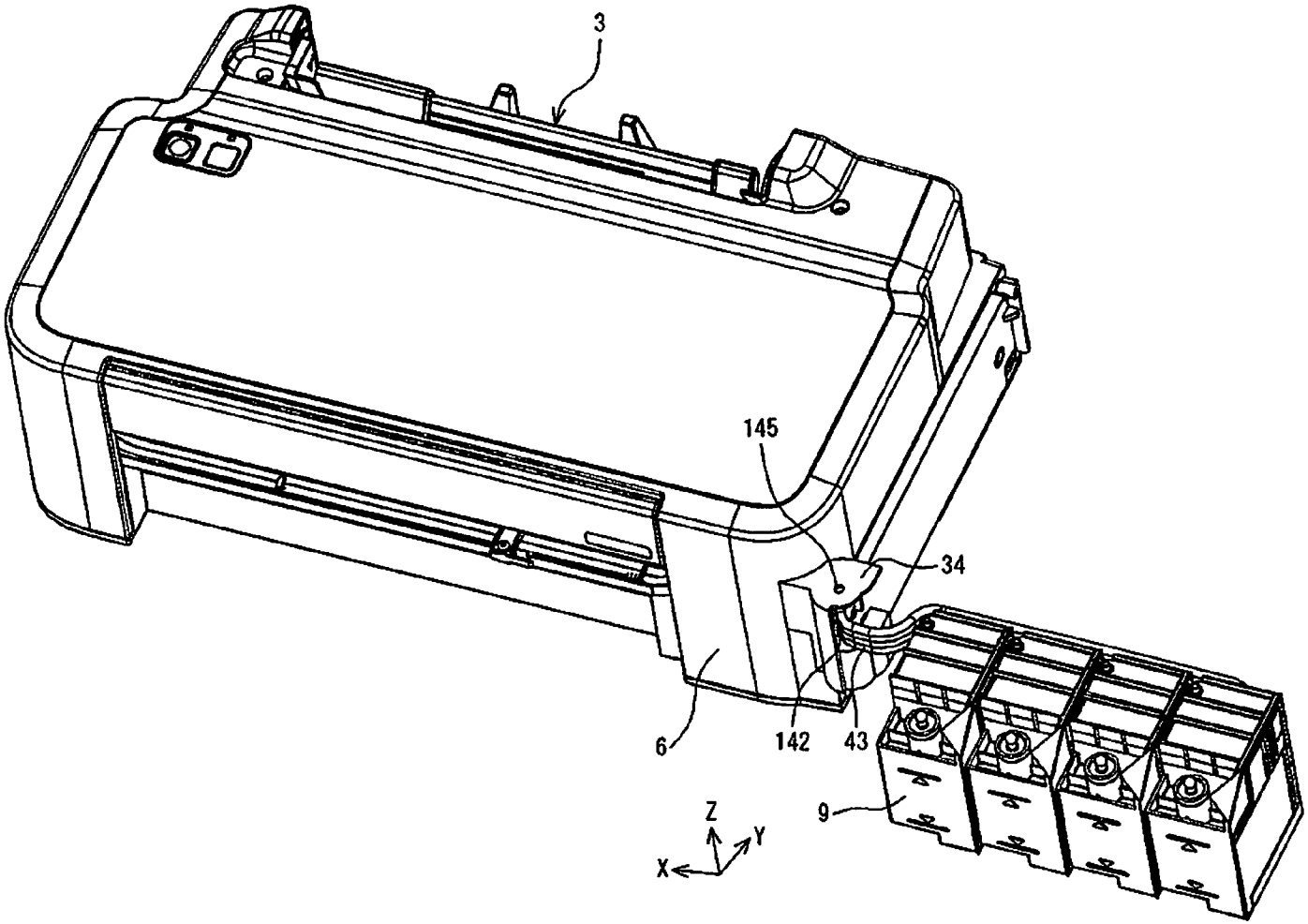
FIG. 13 is a perspective view showing the printer and the tanks according to the first embodiment.

As shown in FIG. 13, in the hinge receiving section 34, a passage 142 that the supply tubes 43 can be penetrated is provided. The supply tubes 43 connected to the tanks 9 extend to the inside of the first case 6 through the passage 142 of the hinge receiving section 34. Also, the aforementioned wires 133 (FIG. 9) extend to the inside of the first case 6 through the passage 142 of the hinge receiving section 34. With such configuration, the supply tubes 43 and the wires 133 connected to the tanks 9 are guided into the inside of the first case 6 by penetrating the hinge part 33 and the hinge receiving section 34 as shown in FIG. 3. Further, in the hinge receiving section 34, a bearing hole 145 is provided in FIG. 13. The shaft section 139 (FIG. 11) of the hinge part 33 is fitted in the bearing hole 145. Therefore, the hinge part 33 is engaged to the hinge receiving section 34. In the state that the hinge part 33 is engaged to the hinge receiving section 34, it is configured with the shaft section 139 as the rotational center.

In the inside of the passage 141, a gap between the inner wall of passage 141 and each of the supply tubes 43, the wires 133, and the wires 137 is mutually and securely obtained. Also, in the inside of the passage 142, a gap between the inner wall of the passage 142 and each of the supply tubes 43, the wires 133, and the wires 137 is securely obtained. Therefore, even when the hinge part 33 is opened or closed, the occurrence of the stress to the supply tubes 43, the wires 133, the wires 137 in the inside of the passage 141 or the inside of the passage 142 is easily avoided. As a result, even when the hinge part 33 is opened or closed, the breakage of the supply tubes 43, the wires 133, and the wires 137 is easily avoided.

In the first embodiment, the hinge part 33 corresponds to the rotation section, the supply tubes 43 correspond to the tube, and the ink inlet section 57 corresponds to the inlet.

In the liquid ejecting system 1 of the first embodiment, the plurality of tanks 9 is rotatably supported with respect to the printer 3 by the hinge part 33. Therefore, when the position of the plurality of tanks 9 is changed, the operation that the tanks 9 are removed from the printer 3 can be omitted. Therefore, the operation at the time that the position of the tanks 9 is changed with respect to the printer 3 can be reduced.

Further, in the first embodiment, the supply tubes 43, the wires 133, and the wires 137 extend from the tanks 9 side to the printer 3 side through the passage 142 provided in the passage 141 and the hinge receiving section 34 provided in the hinge part 33. Therefore, the supply tubes 43, the wires 133, the wires 137 can be protected in the hinge part 33 and the hinge receiving section 34. Therefore, the reliability of the supply tube 43, the wire 133, and the wires 137 is easily improved so that the reliability of the liquid ejecting system 1 is easily improved.

Second Embodiment

Figure 14:
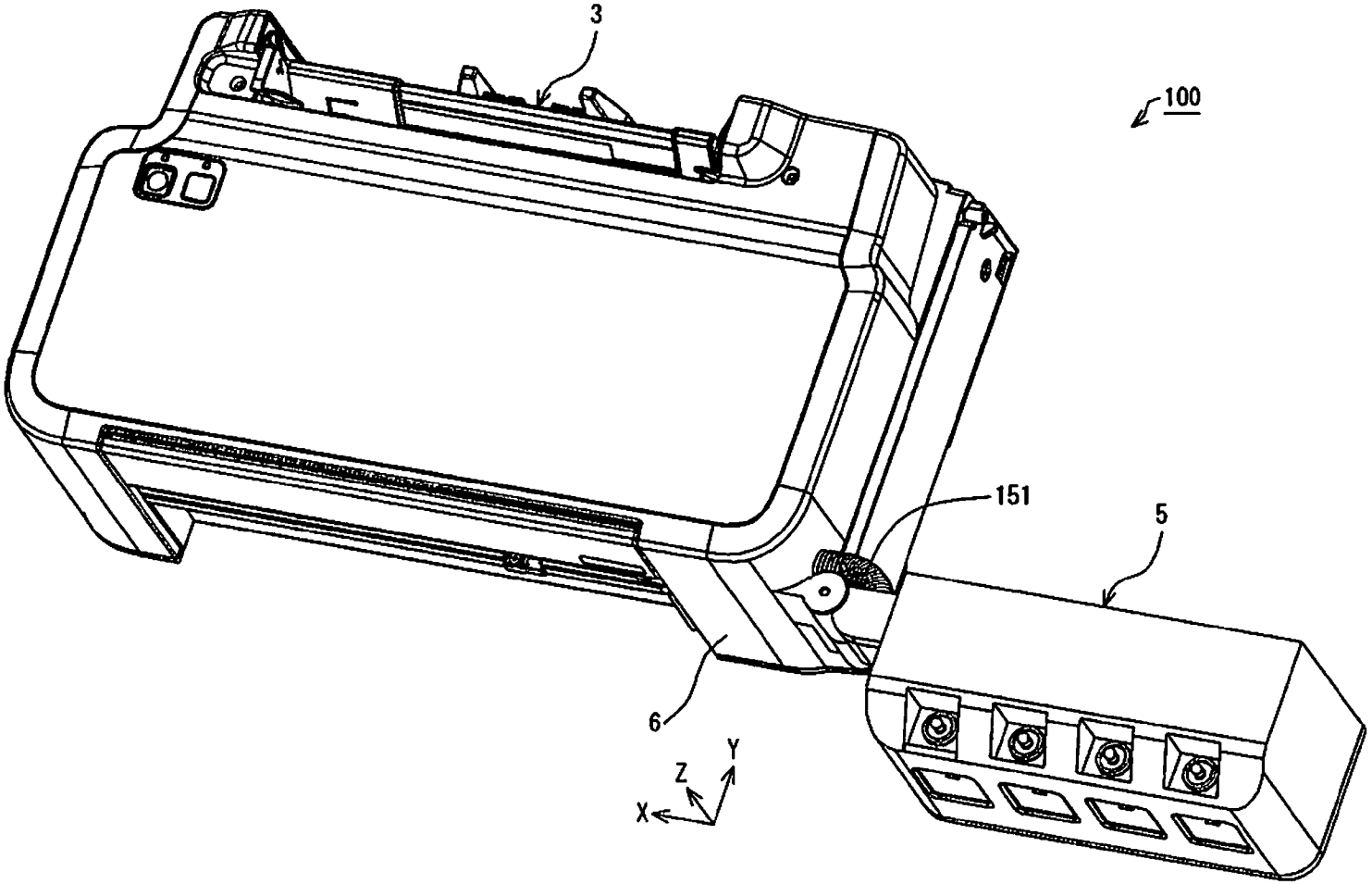
FIG. 14 is a perspective view showing a liquid ejecting system according to a second embodiment.

The liquid ejecting system 100 in the second embodiment is provided with a printer 3, a tank unit 5, and a bellows 151 in FIG. 14. The liquid ejecting system 100 is provided in the same structure as the liquid ejecting system 1 of the first embodiment except the bellows 151. Therefore, hereinafter, the same structure as the first embodiment has the same symbols as the first embodiment so that the detail descriptions are omitted.

Figure 15:
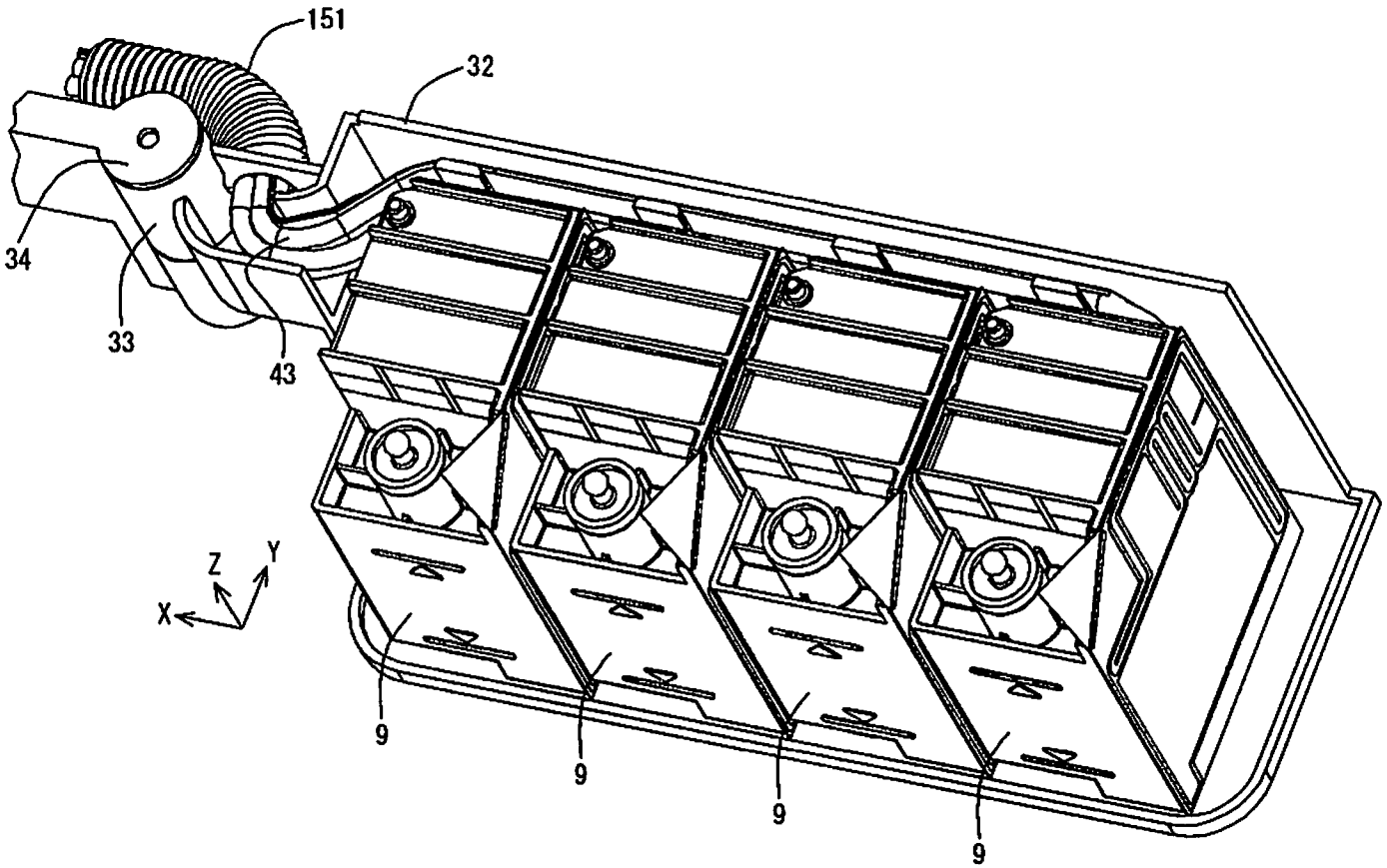
FIG. 15 is a perspective view showing a support frame and bellows according to the second embodiment.
Figure 16:
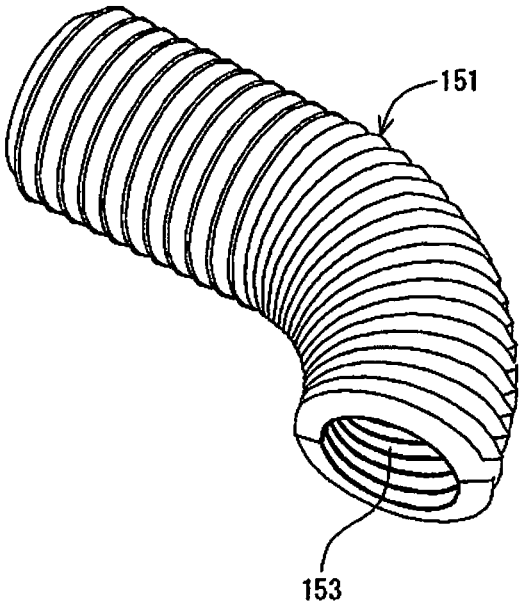
FIG. 16 is a perspective view showing the bellows according to the second embodiment.

As shown in FIG. 15, the bellows 151 is connected to one end side of the support frame 32. The other end side of the bellows 151 is connected to the first case 6 (FIG. 14) of the printer 3. As shown in FIG. 16, the bellows 151 has a cylindrical structure. The inside of the cylindrical shape bellows 151 functions as the passage 153. As shown in FIG. 15, the supply tubes 43 connected to the tanks 9 extend to the inside of the first case 6 (FIG. 14) through the passage 153 of the bellows 151. Further, the aforementioned wires 133 (FIG. 9) and the wires 137 (FIG. 10) extend in the first case through the passage 153 of the bellows 151. With such structure, the supply tubes 43, the wires 133, the wires 137 connected to the tanks 9 are guided into the first case 6 by penetrating the bellows 151.

Figure 17:
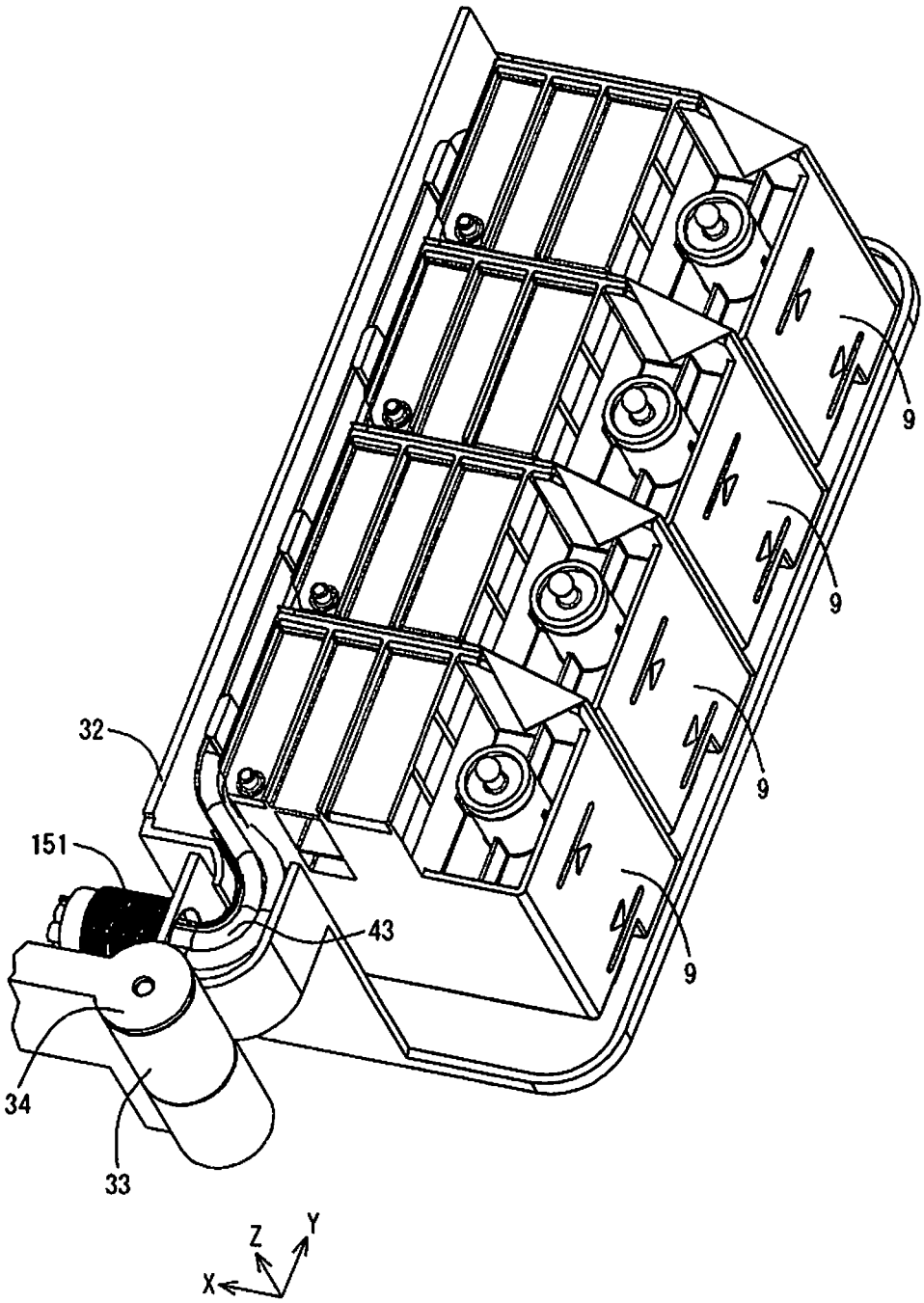
FIG. 17 is a perspective view showing the support frame and the tanks according to the second embodiment.

The bellows 151 has flexibility and has a structure that is expandable and contractible. Therefore, as shown in FIG. 17, there is a structure that is expandable and contractible in response to a condition of the open and close of the hinge part 33. In the inside of the bellows 151, a gap between the inner wall of the bellows 151 and each of the supply tubes 43, the wires 133, the wires 137 is mutually and securely obtained. Therefore, even when the hinge part 33 is opened and closed, in the inside of the bellows 151, the occurrence of the stress to the supply tubes 43, the wires 133, and the wires 137 is easily avoided. As a result, even when the hinge part 33 is opened and closed, the breakage of the supply tubes 43, the wires 133, and the wires 137 is easily avoided. In the second embodiment, the passage 141 of the hinge part 33 and the passage 142 of the hinge receiving section 34 are omitted.

In the second embodiment, the hinge part 33 corresponds to the rotation section, the supply tube 43 corresponds to the tube, the bellows 151 corresponds to the covering section, and the ink inlet section 57 corresponds to the inlet.

The same effects in the first embodiment are obtained in the second embodiment. In the second embodiment, the supply tubes 43, the wires 133, the wires 137 extend through the bellows 151 from the tanks 9 side to the printer 3 side. Therefore, the supply tubes 43, the wires 133, the wires 137 can be protected by the bellows 151. Accordingly, the reliability of the supply tubes 43, the wires 133, and the wires 137 is easily improved, and the reliability of the liquid ejecting system 100 is easily improved.

In the second embodiment, the structure that the supply tubes 43, the wires 133, and the wires 137 are passed through the passage 153 of the bellows 151 is employed. The route of the supply tubes 43, the wires 133, and the wires 137 is not limited to this. As the route of the supply tubes 43, the wires 133, and the wires 137, for example, the structure that the supply tubes 43, the wires 133, the wires 137 are spread in the route of passing through the passage 142 of the hinge part 33 and the passage 142 of the hinge receiving section 34, and the route of passing through the bellows 151 is employed. In this structure, the hinge part 33 provided with the passage 141, and the hinge receiving section 34 provided with the passage 142 are employed. As the method of spreading the route of the supply tubes 43, the wires 133, and the wires 137, for example, it may be considered the various methods such as the method that the route is spread for the supply tube 43, and the route of the wires 133 and the wires 137, the method that the plurality of supply tubes 43 is spread into two, etc.

Third Embodiment

In each of the aforementioned embodiments, the plurality of tanks 9 is not built in the first case 6 that covers the mechanism unit 10. That is, in each of the aforementioned embodiments, the structure that the plurality of tanks 9 is arranged in the outside of the first case 6 is employed. However, the structure that the plurality of tanks 9 is built in the first case 6 may be employed. Hereinafter, as the third embodiment, the structure that the plurality of tanks 9 is built in the case will be described as an example of the multifunction device which is an example of the liquid ejecting system.

Figure 18:
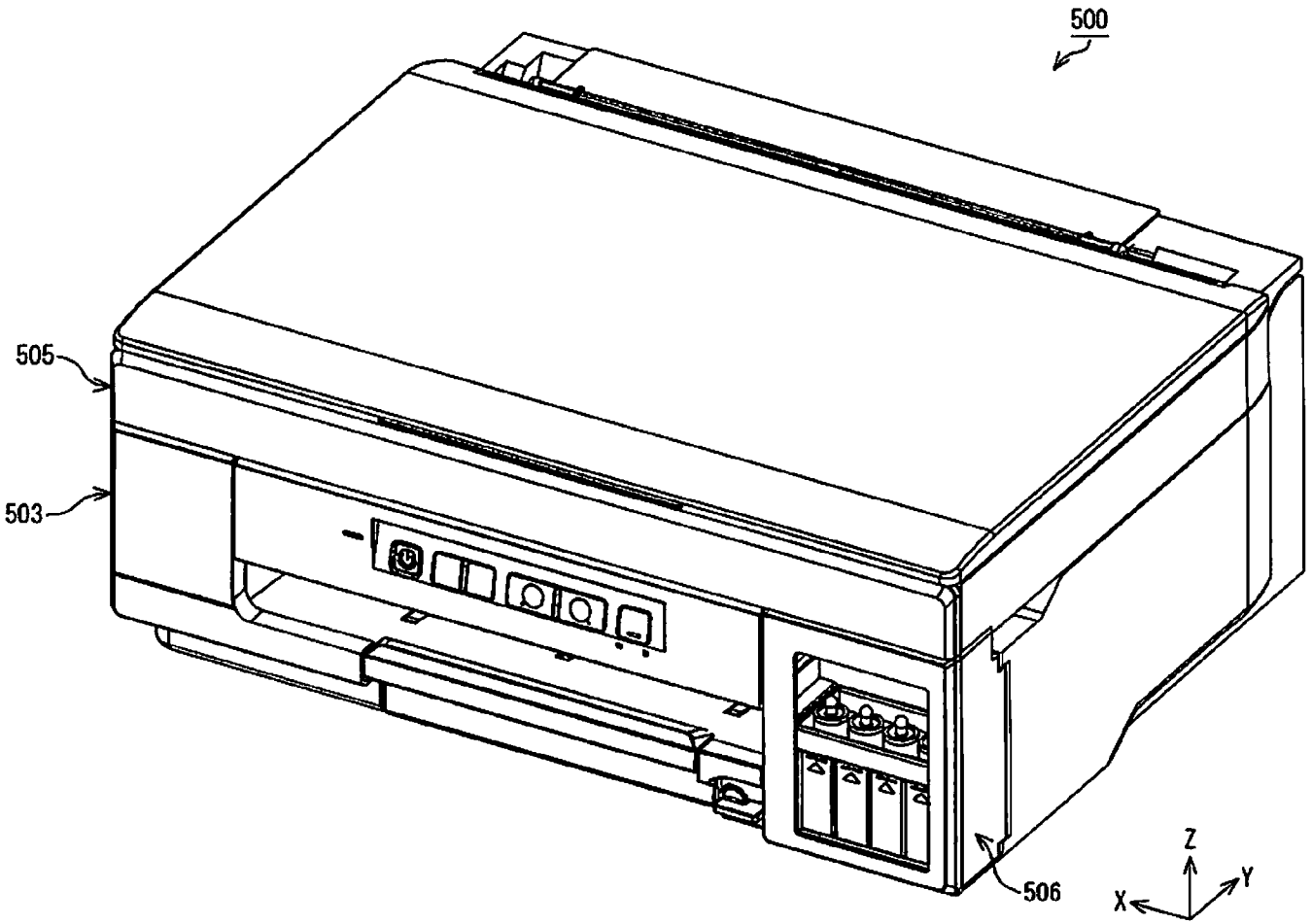
FIG. 18 is a perspective view showing a multifunction device according to the third embodiment.
Figure 19:
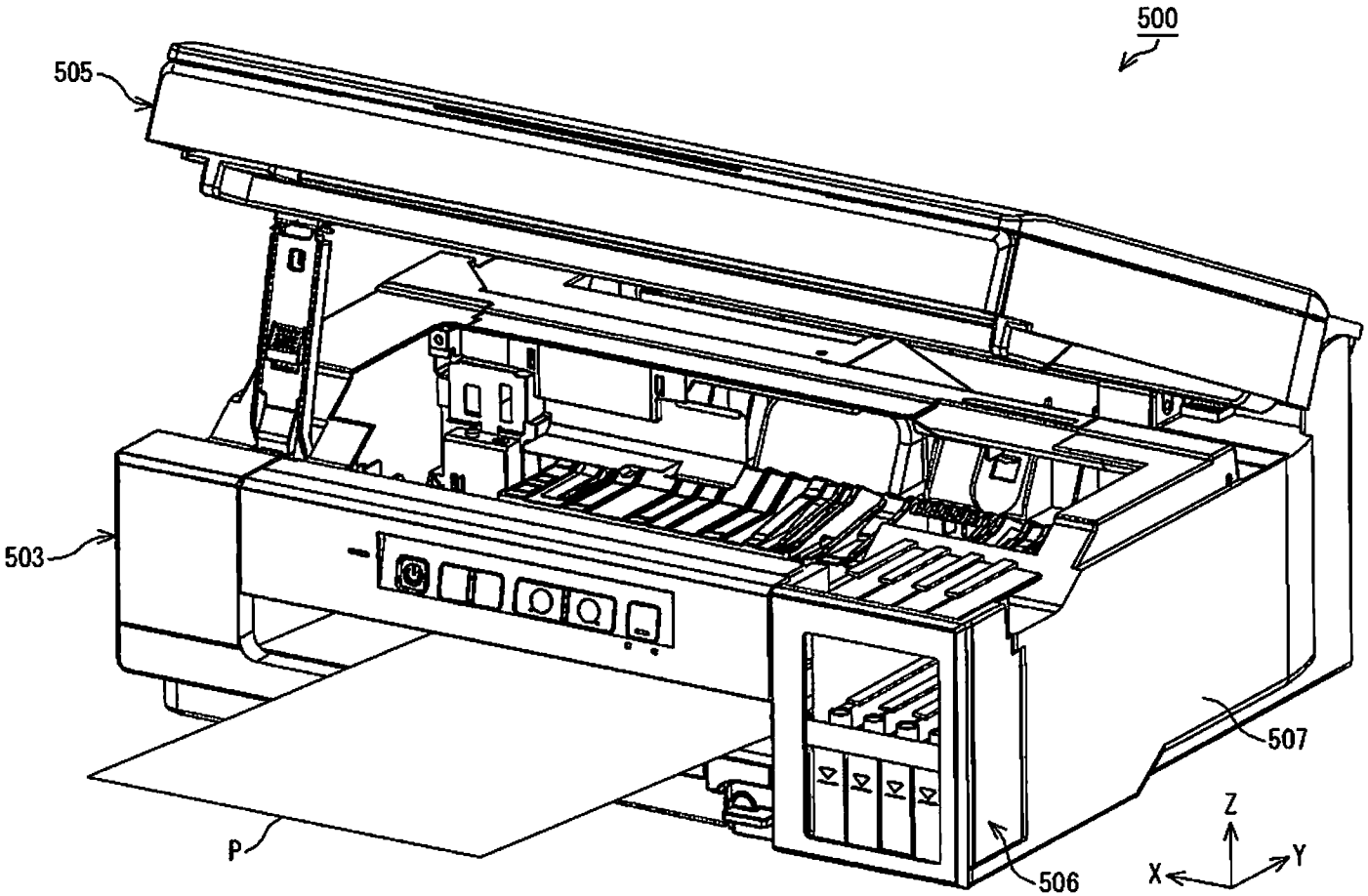
FIG. 19 is a perspective view showing the multifunction device according to the third embodiment.

The multifunction device 500 in the present embodiment is provided with a printer 503, a scanner unit 505, and a tank unit 506 as shown in FIG. 18. In the multifunction device 500, the printer 503 and the scanner unit 505 are overlapped each other. In the state that the printer 503 is in use, the scanner unit 505 is positioned vertically upward of the printer 503. In FIG. 18, the XYZ axes that are the coordinate intersecting with each other are attached. Hereinafter, the XYZ axes are attached in the drawings if necessary. The XYZ axes in FIG. 18 and the XYZ axes in FIG. 19 are applied based on the XYZ axes in FIG. 1. Also, in the multifunction device 500, in the structure that is the same as the liquid ejecting system 1, the symbols, which are the same symbols in the liquid ejecting system 1, are applied so that the detailed description is omitted.

The scanner unit 505 is the flat bed-type, and is provided with an image element (not shown) such as an image sensor, an original platen, and a lid. The scanner unit 505 can read images, etc. recorded in a medium such as a paper as the image data via the imaging element. Therefore, the scanner unit 505 functions as a reader for an image, etc. As shown in FIG. 19, the scanner unit 505 is configured rotatably with respect to a case 507 of the printer 503. The surface in the printer 503 side of the original platen of the scanner unit 505 covers the case 507 of the printer 503 and has the function as the lid of the printer 503.

Figure 20:
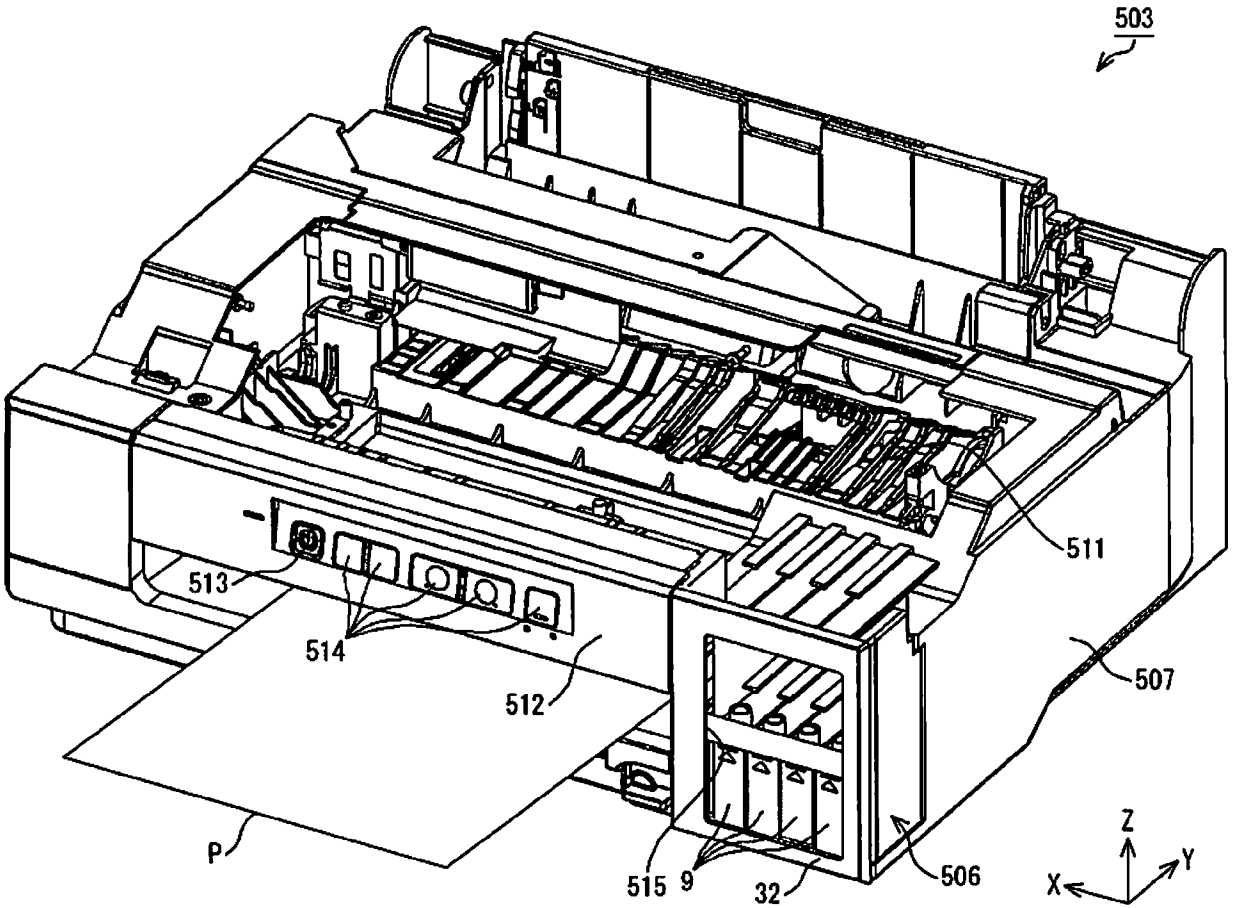
FIG. 20 is a perspective view showing a printer and a tank unit according to the third embodiment.

The printer 503 can perform a printing to a print medium P such as a print paper by the ink which is an example of the liquid. As shown in FIG. 20, the printer 503 is provided with the case 507 and the plurality of tanks 9 which is an example of the liquid storing container. The case 507 is a member that integrally configures the outer shell of the printer 503, and stores the mechanism unit 511 of the printer 503. The plurality of tanks 9 is stored in the case 507, and the inks used for printing are respectively stored. In the printer 503, four tanks 9 are provided. In the four tanks 9, the types of the ink are mutually different. In the printer 503, as the types of the ink, four types of black, yellow, magenta, cyan are employed. The four tanks in which the types of ink are mutually different are provided respectively.

Also, the printer 503 is provided with an operation panel 512. In the operation panel 512, a power button 513 and other control buttons 514 are provided. The operator who controls the printer 503 can controls the power button 513 and the control button 514 in the state of facing the operation panel 512. In the printer 503, the surface provided with the operation panel 512 is defined as the front surface.

The tank unit 506 is provided in the front surface side of the printer 503. The tank unit 506 is provided with the support frame 32. The support frame 32 is configured as a container shape. The four tanks 9 are stored in the container-shaped support frame 32. In the support frame 32, in the same surface side of the front surface of the printer 503, the window part 515 is provided. The window part 515 has light permeability. In the position overlapped with the window part 515, the aforementioned four tanks 9 are provided. Therefore, the operator can view the four tanks 9 through the window part 515.

In the printer 503, the part facing to the window part 515 of each tank 9 has light permeability. The ink in the tank 9 is viewed from the part of each tank 9 having the light permeability. Accordingly, the operator can view the amount of the ink in each tank 9 by viewing the four tanks 9 through the window part 515. In the printer 503, the window part 515 is provided in the front surface side of the printer 503 so that the operator can view each tank 9 from the window part 515 in the state of facing the operation panel 512. Therefore, while controlling the printer 503, the operator can understand the remaining amount of the ink in each tank 9.

The printer 503 has a mechanism unit 511. The mechanism unit 511 has the same structure as the mechanism unit 10 of the printer 3 (FIG. 4). Therefore, in the printer 503, in the same manner as the printer 3, the carriage 45 is moved along the X-axis direction by transferring the power to the carriage 45 from the motor 53 through the timing belt 55. The print head 47 is mounted on the carriage 45. Therefore, the print head 47 is moved in the X-axis direction via the carriage 45 by the head conveyance mechanism. While the relative position of the print head 47 with respect to the print medium P is changed by the medium conveyance mechanism and the head conveyance mechanism, the printing is performed on the print medium P by ejecting the ink from the print head 47.

In the same manner as the first embodiment and the second embodiment, in the third embodiment, the four tanks 9 are also supported by the support frame 32. The support frame 32 is rotatably configured with respect to the case 507 (FIG. 20). Therefore, in the third embodiment, the four tanks 9 are rotatably configured with respect to the case 507 (FIG. 20). Hereinafter, examples of a rotation mechanism that rotates the tanks 9 will be described.

Example 1

Figure 21:
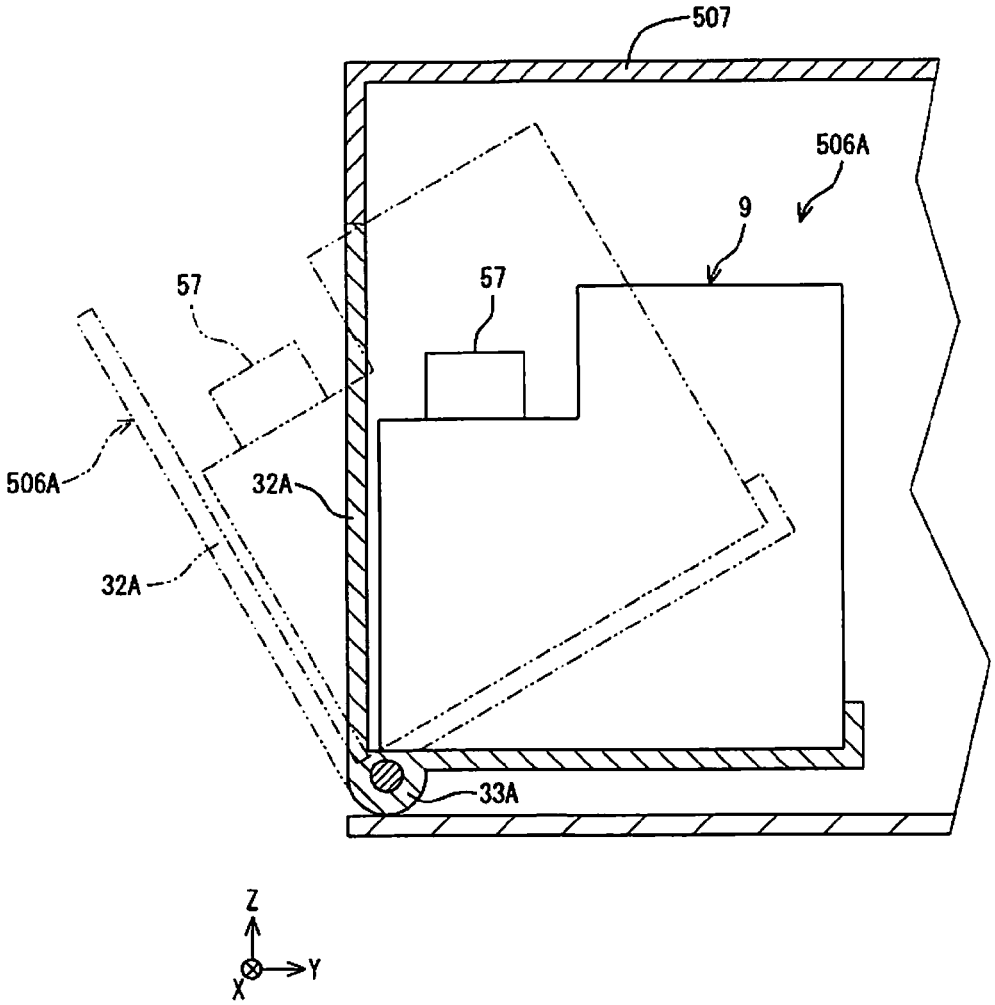
FIG. 21 is a cross-sectional view showing the tank unit according to Example 1 when cutting in a YZ plane surface.

As shown in FIG. 21 that is a cross-sectional view when cutting the tank unit 506A in the YZ plane surface, in the tank unit 506A of Example 1, a hinge part 33A is provided in the support frame 32A. The rotation axis of the hinge part 33A extends along the X-axis direction. Therefore, the support frame 32A is rotated so as to draw the rotation track of the circular arc on the YZ surface in the rotational axis, which extends along the X-axis direction, as the rotation center. When the hinge part 33A is opened, the inlet sections 57 of the tanks 9 are exposed to the outside of the case 507. When the hinge part 33A is closed, the ink can be injected to the inside of the tank 9 from the ink inlet sections 57. In Example 1, the supply tubes 43, the wires 133, and the wires 137 extend to the printer 503 side through the passage (not shown) provided in the hinge part 33A in the same manner as the first embodiment. In Example 1, the same effects as the first embodiment can be obtained.

Example 2

Figure 22:
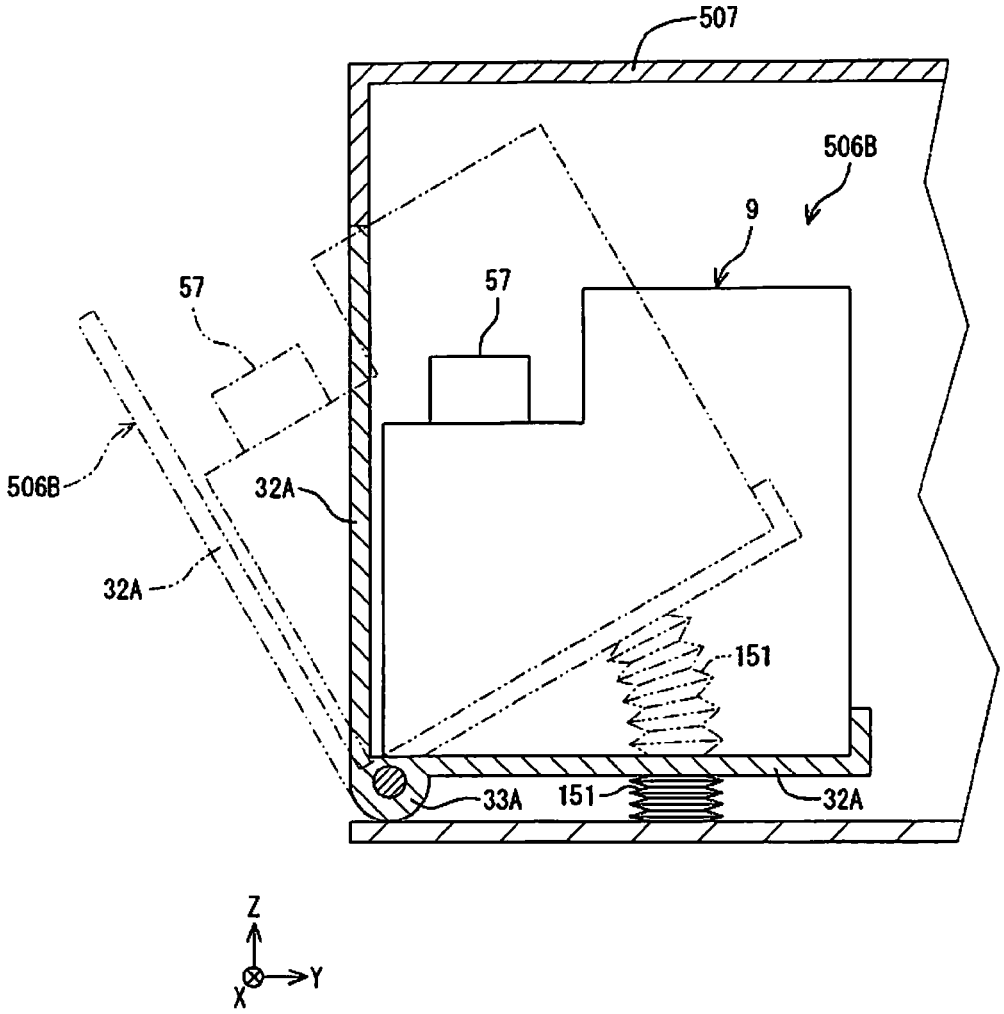
FIG. 22 is a cross-sectional view showing the tank unit according to Example 2 when cutting in the YZ plane surface.

As shown in FIG. 22, in the tank unit 506B of Example 2, a bellows 151 is provided on the bottom surface of the support frame 32A. In the same manner as the second embodiment, a passage 153 (FIG. 16) is provided in the bellows 151. In Example 2, the supply tubes 43, wires 133, and the wires 137 extend in the printer 503 side through the passage 153 of the bellows 151. In Example 2, the same effects as the second embodiment are obtained. In Example 2, in the same manner as the second embodiment, the structure spreading the supply tubes 43, the wires 133, or the wires 137 into the routes of passing through the passage of the hinge part 33A and passing through the bellows 151 may be employed.

Example 3

Figure 23:
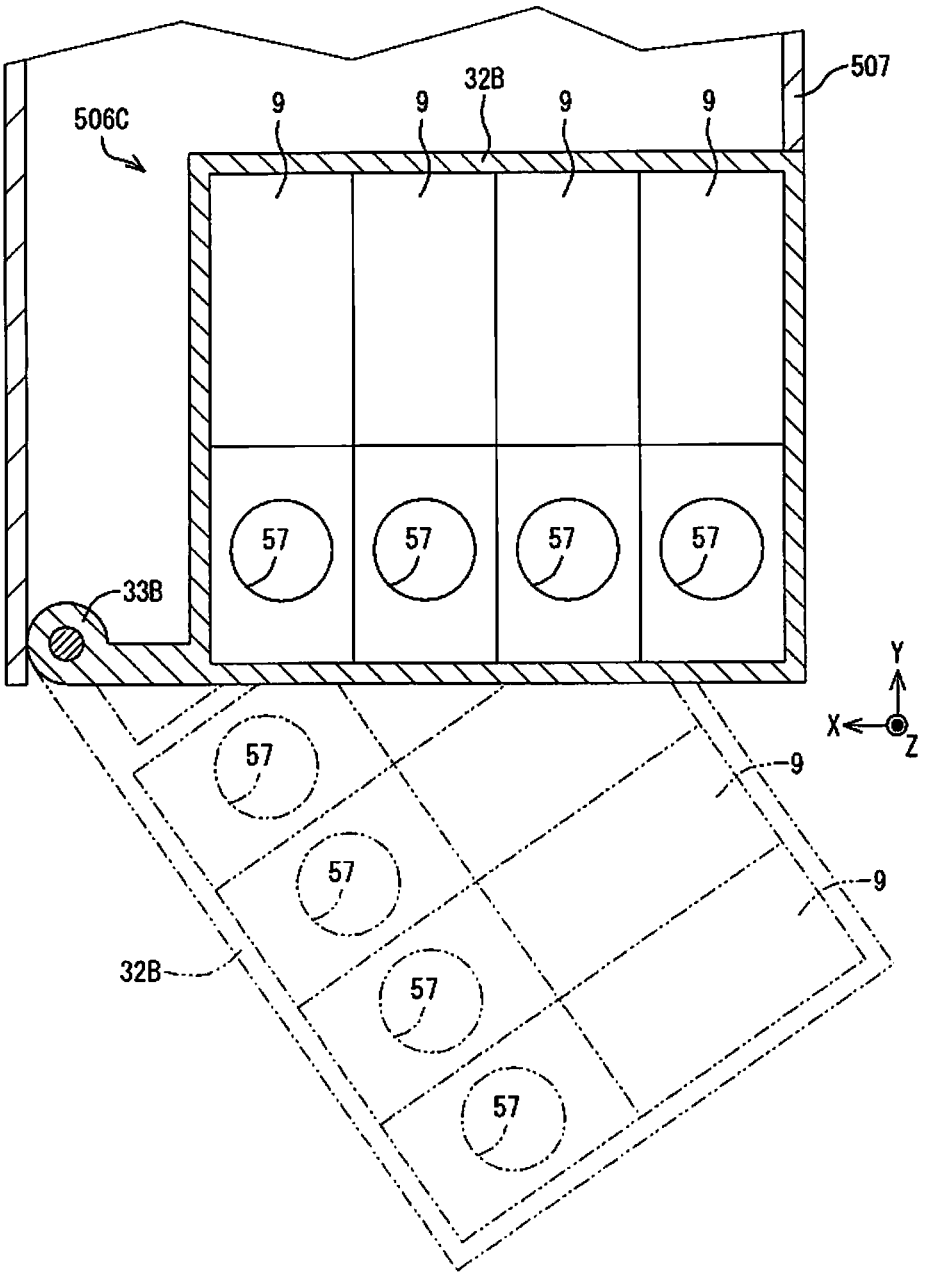
FIG. 23 is a cross-sectional view showing the tank unit according to Example 3 when cutting in the XY plane surface.

In the tank unit 506C of Example 3, as shown in FIG. 23 that is a cross-sectional view when cutting the tank unit 506C in the XY plane surface, a hinge part 33B is provided in a support frame 32B. The rotation axis of the hinge part 33B extends along the Z-axis direction. Therefore, the support frame 32B is rotated so as to draw the rotation track of the circular arc on the XY surface in the rotation axis, which extends along the Z-axis direction, as the rotation center. When the hinge part 33B is opened, the ink inlet sections 57 of the tanks 9 are exposed outside of the case 507. When the hinge part 33B is opened, the operator can inject the ink into the tanks 9 from the ink inlet sections 57. In Example 3, the supply tubes 43, the wires 133, or the wires 137 extend in the printer 503 side through the passage (not shown) provided in the hinge part 33B in the same manner as the first embodiment. In Example 3, the same effects as the first embodiment are obtained.

Example 4

Figure 24:
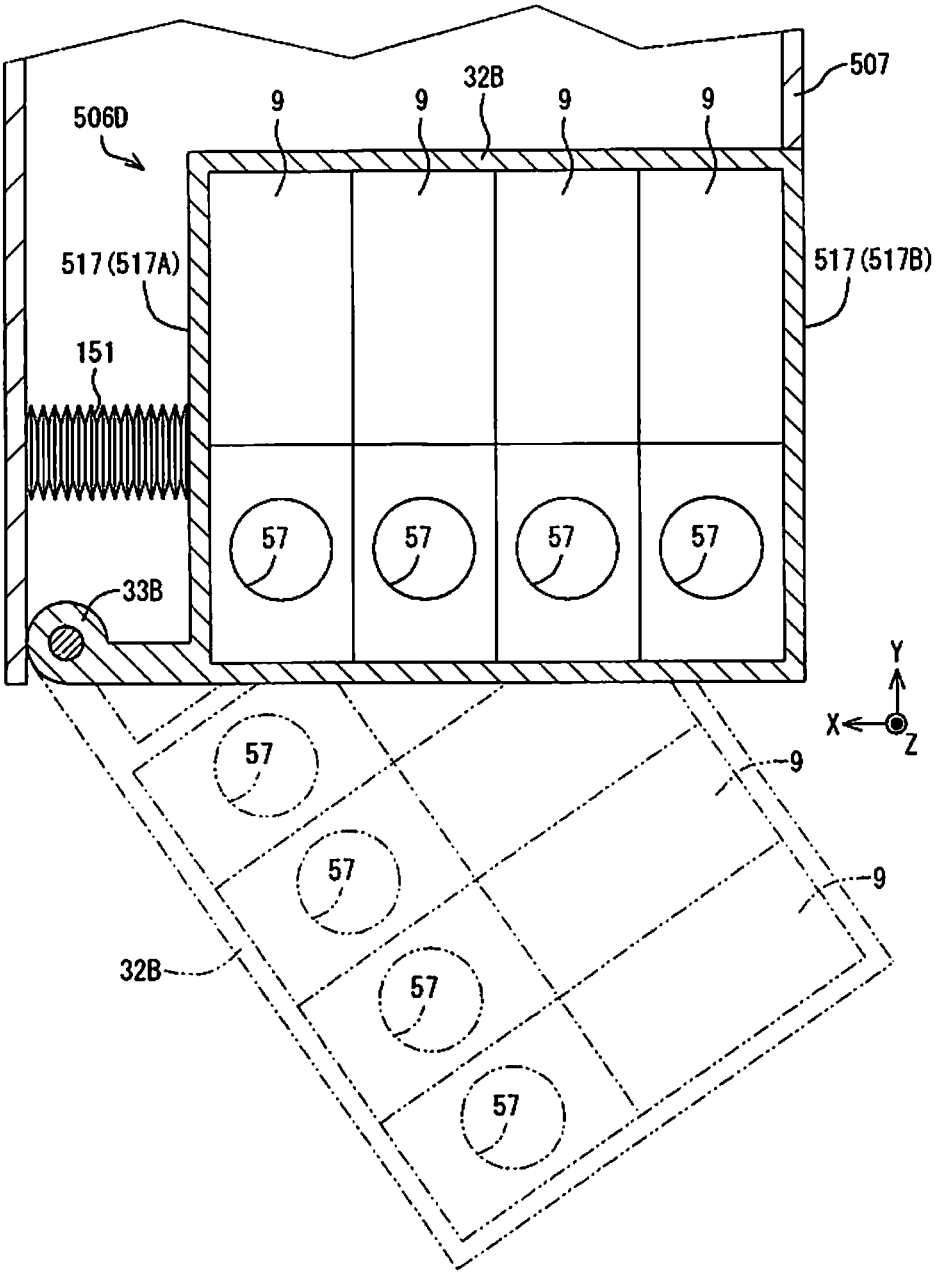
FIG. 24 is a cross-sectional view showing the tank unit according to Example 4 when cutting in the XY plane surface.

As shown in FIG. 24, in the tank unit 506D of Example 4, a bellows 151 is provided in the side surface 517 of the support frame 32B. The bellows 151 is provided in the side surface 517A, which is the side close to the hinge part 33B, among two of the side surface 517A and the side surface 517B that are aligned in the X-axis direction. In the same manner as the second embodiment, a passage 153 (FIG. 16) is provided in the bellows 151. In Example 4, the supply tubes 43, the wires 133, and the wires 137 extend in the printer side through the passage 153 of the bellows 151. In Example 4, the same effects as the second embodiment are obtained. In Example 4, in the same manner as the second embodiment, the structure spreading the supply tubes 43, the wires 133, or the wires 137 into the routes of passing through the passage of the hinge part 33B or passing through the bellows 151 may be employed.

Example 5

Figure 25:
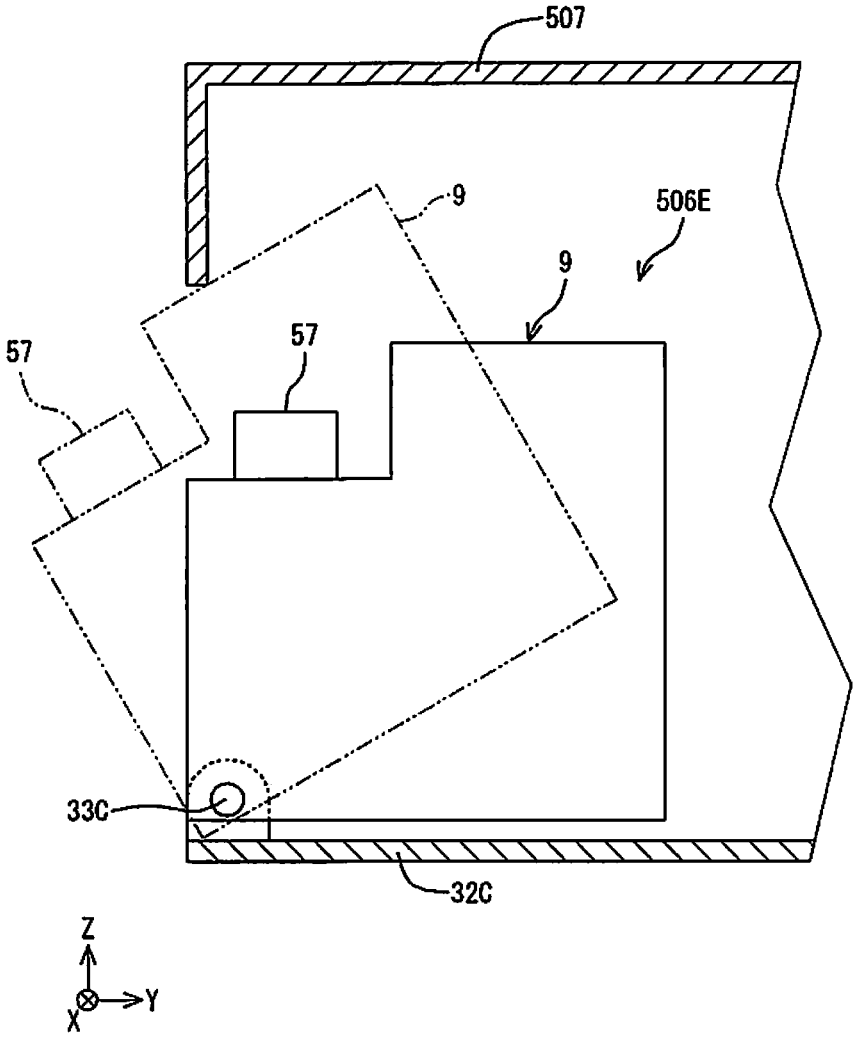
FIG. 25 is a cross-sectional view showing the tank unit according to Example 5 when cutting in the YZ plane surface.

In a tank unit 506E of Example 5, as shown in the two-dot chain line in FIG. 25, the structure that the tanks 9 are rotated with respect to the support frame 32C is employed. In this structure, the posture or the position of the support frame 32C with respect to the case 507 is not changed. In the tank unit 506E, a hinge part 33C is provided in the tanks 9. The rotation axis of the hinge part 33C extends along the X-axis direction. Therefore, the tanks 9 are rotated so as to draw the rotation track of the circular arc on the YZ surface in the rotation axis, which extends along the X-axis direction, as the rotation center. When the hinge part 33C is opened, the ink inlet sections 57 of the tanks 9 are exposed outside of the case 507. When the hinge part 33C is opened, the operator can inject the ink into the tanks 9 from the ink inlet sections 57. In Example 5, the supply tubes 43, the wires 133, or the wires 137 extend in the printer 503 side through the passage (not shown) provided in the hinge part 33C in the same manner as the first embodiment. In Example 5, the same effects as the first embodiment are obtained.

Example 6

In the structure of Example 5, the bellows 151 shown in FIG. 16 is added, and this is Example 6. In Example 6, the supply tubes 43, the wires 133, and the wires 137 extend to the printer 503 side through the passage 153 of the bellows 151. In Example 6, the same effects as the second embodiment are obtained. In Example 6, in the same manner as the second embodiment, the structure spreading the supply tubes 43, the wires 133, or the wires 137 into the routes of passing through the passage of the hinge part 33C and passing through the bellows 151 is employed. In Example 5 and Example 6, the structure that the support frame 32C is omitted is also obtained. In the structure that the support frame 32C is omitted, for example, the hinge receiving section 34 is provided in the case 507 so that the structure that the tanks 9 are rotated with respect to the case 507. In this structure, the same effects of Example 5 or Example 6 are obtained.

Example 7

Figure 26:
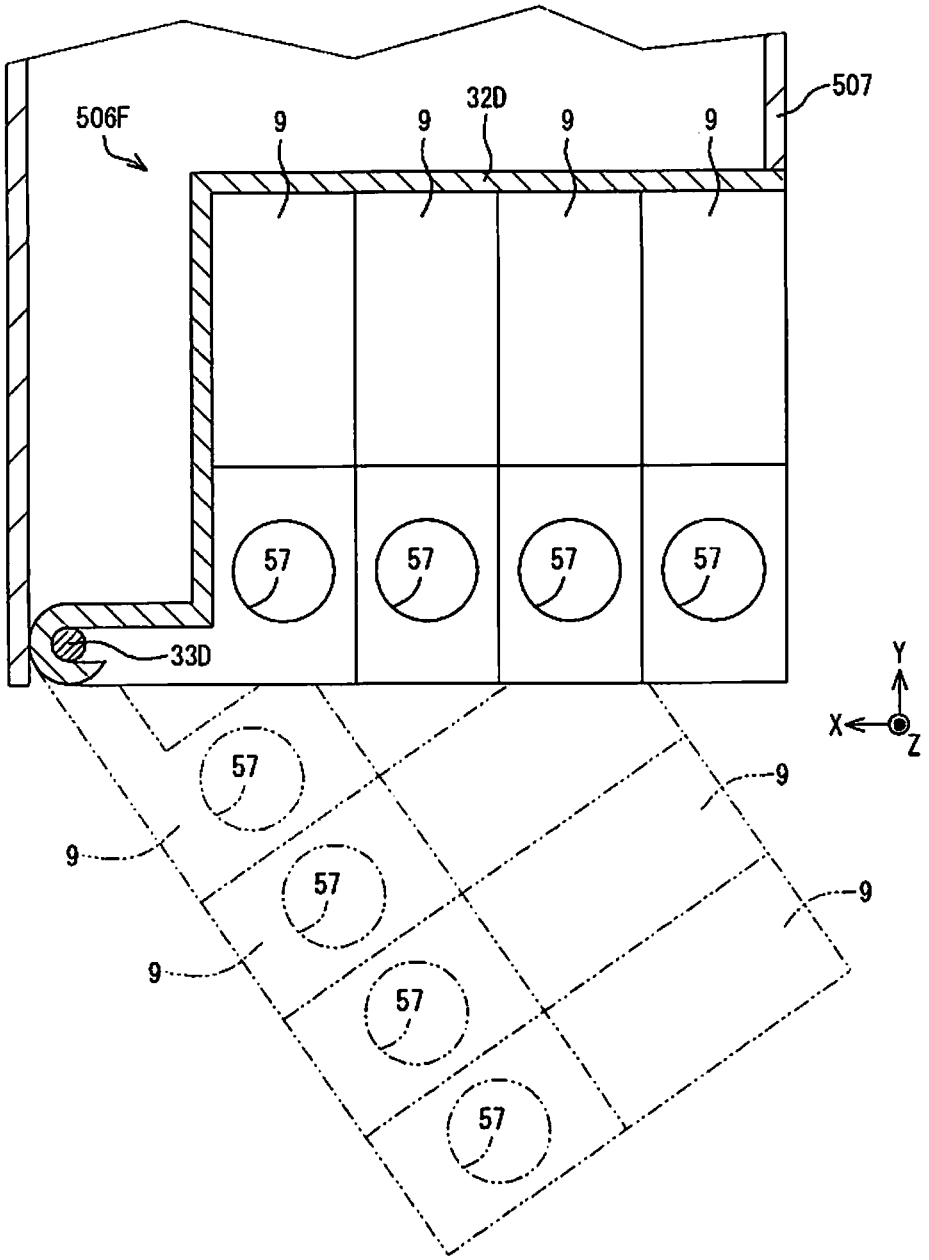
FIG. 26 is a cross-sectional view showing the tank unit according to Example 7 when cutting in the XY plane surface.

In the tank unit 506F of Example 7, as shown in FIG. 26, the structure that the tanks 9 are rotated with respect to the support frame 32D is employed. In this structure, the posture or the position of the support frame 32D is changed with respect to the case 507. In the tank unit 506F, the hinge part 33D is provided in the tanks 9. The rotation axis of the hinge part 33D extends along the Z-axis direction. Therefore, the support frame 32D is rotated so as to draw the rotation track of the circular art on the XY surface in the rotation axis, which extends along the Z-axis direction, as the rotation center. When the hinge part 33D is opened, the ink inlet sections 57 of the tanks 9 are exposed outside of the case 507. When the hinge part 33D is opened, the operator can inject the ink into the tanks 9 from the ink inlet sections 57. In Example 7, the supply tubes 43, the wires 133, or the wires 137 extend in the printer 503 side through the passage (not shown) provided in the hinge part 33D in the same manner as the first embodiment. In Example 7, the same effects as the first embodiment are also obtained.

Example 8

In the structure of Example 7, the bellows 151 shown in FIG. 16 is added, and this is Example 8. In Example 8, the supply tubes 43, the wires 133, and the wires 137 extend to the printer 503 side through the passage 153 of the bellows 151. In Example 8, the same effects as the second embodiment are also obtained. In Example 8, in the same manner as the second embodiment, the structure spreading the supply tubes 43, the wires 133, or the wires 137 into the routes of passing through the passage of the hinge part 33D and passing through the bellows 151 is employed. In Example 7 or Example 8, the structure that the support frame 32D is omitted is also obtained. In the structure that the support frame 32D is omitted, for example, the hinge receiving section 34 is provided in the case 507 so that the structure that the tanks 9 are rotated with respect to the case 507. In this structure, the same effects of Example 7 or Example 8 are obtained.

In each of the aforementioned embodiments, the liquid ejecting device may be a liquid ejecting device that consumes the liquid other than the ink by ejecting, ejecting or applying. As the state of the liquid that is ejected in the micro-droplet amount from the liquid ejecting device, it includes a granular, a tear-like, and a thread-like tail. In addition, the so-called liquid may be a material which the liquid ejecting device may jet. For example, a substance may be acceptable if the substance is in a state of liquid phase. Liquid-like bodies with high or low viscosity, sol, gel water, other inorganic solvents, organic solvents, solutions, liquid resins and liquid metals (metallic melt) may be included. In addition, without being limited to liquid as a state of substance, anything in which particles of functional material formed from solids such as pigments or metal particles are dissolved, dispersed or mixed in a solvent may be included. Other than the ink as described in the embodiment, a liquid crystal, etc. may be mentioned as a typical example of the liquid. Herein, the ink includes various liquid compositions such as a general aqueous ink, oil-based ink, gel ink, hot melt ink, etc. As a specific example of the liquid ejecting device, for example, there may be a liquid ejecting device that ejects liquid containing, in the form of dispersed or dissolved material, electrode materials or coloring materials, etc. used in manufacturing a liquid crystal display, an EL (electroluminescence) display, a plane emission display, a color filter, etc. Further, it may be a liquid ejecting device that ejects bioorganic substance used for biochip fabrication, a liquid ejecting device that ejects liquid which becomes a sample by being used as a precision pipette, a printing device, a micro-dispenser, etc. In addition, a liquid ejecting device that ejects a pinpoint of lubricant to precision machinery such as timepieces or cameras, etc., a liquid ejecting device that ejects transparent resin solution of ultraviolet curable resin, etc. onto a substrate in order to form a micro hemispherical lens (optical lens) which is used in optical communication element, etc., and a liquid ejecting device that ejects an etching solution such as acid, alkali, etc. in order to etch the substrate, etc. may be employed.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejecting system comprising:

a body having a front surface;

a liquid ejecting device configured and arranged to eject liquid on a medium and disposed inside of the body;

a discharge section configured and arranged to discharge the medium from the front surface of the body to outside of the body in a discharging direction;

a liquid storing container configured and arranged to store the liquid that is supplied to the liquid ejecting device, the liquid storing container having an inlet configured and arranged to receive the liquid from outside of the liquid storing container;

a tank unit containing the liquid storing container within the tank unit;

a rotation section rotatably supporting the tank unit with respect to the body, the rotation section being formed integrally with the tank unit and being rotatably coupled to the body such that the tank unit rotates around an axis of the rotation unit relative to the body, the rotation section including a passage that is arranged in the rotation section and extends from the tank unit to the body; and a tube having flexibility and provided between the liquid storing container and the liquid ejecting device, the tube being configured and arranged to supply the liquid, which is in the liquid storing container, to the liquid ejecting device, the tube extending toward the liquid ejecting device from the liquid storing container through the passage of the rotation section, the rotation section being configured and arranged to move the liquid storing container between an opening position and a closed position relative to the body such that the inlet is positioned in the discharging direction relative to the front surface while the liquid storing container is at the opening position, and such that the inlet is positioned, relative to the front surface, in an opposite direction opposite the discharging direction while the liquid storing container is at the closed position.

2. The liquid ejecting system according to claim 1, further comprising a wire configured and arranged to transfer information related to the liquid storing container, wherein the wire extends toward the liquid ejecting device from the liquid storing container through the passage provided in the rotation section.

3. The liquid ejecting system according to claim 2, further comprising a detection section provided in the liquid storing container and configured and arranged to detect the liquid in the liquid storing container, wherein the information related to the liquid storing container includes ink amount detected by the detection section.

4. The liquid ejecting system according to claim 2, further comprising a memory device provided in the liquid storing container and configured to record the information related to the liquid storing container, wherein the information related to the liquid storing container includes information read out from the memory device.

5. The liquid ejecting system according to claim 1, further comprising a wire configured and arranged to transfer information related to the liquid storing container, and a covering section provided between the liquid storing container and the liquid ejecting device, and covering at least a part of the wire, wherein the wire extends toward the liquid ejecting device from the liquid storing container through the covering section.

6. The liquid ejecting system according to claim 5, further comprising a detection section provided in the liquid storing container and configured and arranged to detect the liquid in the liquid storing container, wherein the information related to the liquid storing container includes ink amount detected by the detection section.

7. The liquid ejecting system according to claim 1, wherein the tank unit and the rotation section are formed in an integral molding.

8. The liquid ejecting system according to claim 1, wherein the liquid storing container has a visible surface that allows viewing of a remaining amount of stored liquid, and a position of the visible surface with respect to the liquid ejecting device is changeable by a rotation of the rotation section.

9. The liquid ejecting system according to claim 1, further comprising a second liquid storing container, wherein the liquid storing container and the second liquid storing container are moved together by a rotation of the rotation section, and a movable distance of the liquid storing container with respect to the liquid ejecting device and a movable distance of the second liquid storing container with respect to the liquid ejecting device are different from each other.

10. The liquid ejecting system according to claim 1, wherein the liquid storing container further has a supply port that is different from the inlet and is configured and arranged to supply the liquid to the liquid ejecting device.

11. The liquid ejecting system according to claim 1, wherein the rotation section has an axle extending in a vertical direction in which an axis of the inlet extends.

* * * * *